US010098409B1

(12) United States Patent
Cross et al.

(10) Patent No.: US 10,098,409 B1
(45) Date of Patent: Oct. 16, 2018

(54) PRE-TENSIONED ARTICLE AND METHOD OF MAKING

(71) Applicant: NIKE, Inc., Beaverton, OR (US)

(72) Inventors: Tory M. Cross, Portland, OR (US); Bryan N. Farris, North Plains, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/604,870

(22) Filed: May 25, 2017

(51) Int. Cl.

| | |
|---|---|
| ***A43B 13/14*** | (2006.01) |
| ***A43B 3/26*** | (2006.01) |
| ***A43D 3/02*** | (2006.01) |
| ***A43B 13/18*** | (2006.01) |
| ***A43B 23/02*** | (2006.01) |
| ***A43B 9/12*** | (2006.01) |
| ***A43B 9/02*** | (2006.01) |

(52) U.S. Cl.
CPC ..... *A43B 3/26* (2013.01); *A43B 9/02* (2013.01); *A43B 9/12* (2013.01); *A43B 13/141* (2013.01); *A43B 13/186* (2013.01); *A43B 13/188* (2013.01); *A43B 23/027* (2013.01); *A43B 23/028* (2013.01); *A43B 23/0275* (2013.01); *A43D 3/02* (2013.01)

(58) Field of Classification Search
CPC .... A43B 3/26; A43B 9/02; A43B 9/12; A43B 13/141; A43B 13/186; A43B 13/188; A43D 3/02
See application file for complete search history.

(56) References Cited

U.S. PATENT DOCUMENTS

| | | | | |
|---|---|---|---|---|
| 3,757,435 | A * | 9/1973 | Schwartz | A43B 13/38 36/30 R |
| 8,084,117 | B2 | 12/2011 | Lalvani | |
| 8,333,021 | B2 * | 12/2012 | Johnson | A43B 3/14 36/11 |
| 8,916,262 | B2 | 12/2014 | Hook et al. | |
| 2009/0183392 | A1 * | 7/2009 | Shane | A43B 1/0027 36/97 |
| 2011/0247237 | A1 * | 10/2011 | Jara | A43B 3/0036 36/103 |
| 2012/0021167 | A1 | 1/2012 | Plant | |
| 2014/0101816 | A1 * | 4/2014 | Toronjo | A41D 31/0011 2/69 |
| 2014/0109286 | A1 * | 4/2014 | Blakely | A41D 31/02 2/69 |
| 2015/0245685 | A1 * | 9/2015 | Cross | A43B 13/187 36/104 |
| 2015/0250259 | A1 * | 9/2015 | Attey | A43B 3/108 36/103 |

(Continued)

FOREIGN PATENT DOCUMENTS

| | | | |
|---|---|---|---|
| GB | 745335 | A | 2/1956 |
| WO | 2016144410 | A1 | 9/2016 |

*Primary Examiner* — Ted Kavanaugh
(74) *Attorney, Agent, or Firm* — Quinn IP Law

(57) ABSTRACT

A pre-tensioned article and method of making an article of footwear involving pre-tensioning a sole structure during manufacturing. In some embodiments, the sole structure may include a plurality of apertures that provide an auxetic effect. In further embodiments, the upper may also be pre-tensioned in a similar manner as the sole structure.

16 Claims, 22 Drawing Sheets

(56) References Cited

U.S. PATENT DOCUMENTS

| | | | | |
|---|---|---|---|---|
| 2016/0058121 | A1* | 3/2016 | Langvin | A43B 5/06 36/103 |
| 2016/0095385 | A1* | 4/2016 | Nordstrom | A43B 13/181 36/29 |
| 2017/0280823 | A1* | 10/2017 | Langvin | A43B 13/141 |

* cited by examiner

PRE-TENSIONED ARTICLE AND METHOD OF MAKING

BACKGROUND

The present disclosure relates generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
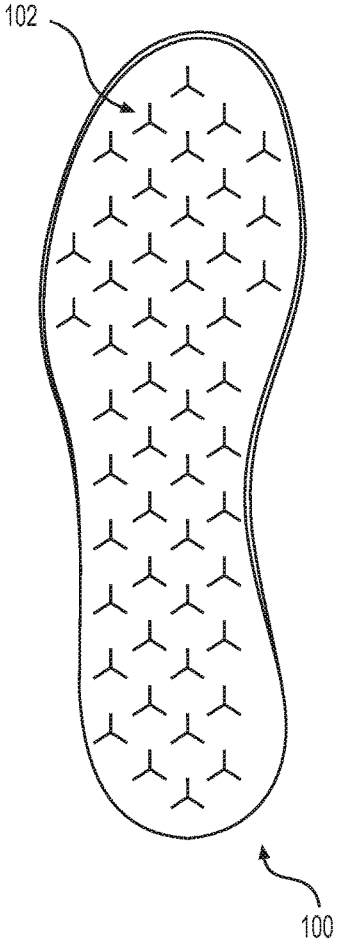
FIG. 1 is a schematic view of an embodiment of a sole structure with auxetic apertures in a relaxed state.

For clarity, the detailed descriptions herein describe certain exemplary embodiments, but the disclosure herein may be applied to any article of footwear comprising certain features described herein and recited in the claims. In particular, although the following detailed description discusses exemplary embodiments in the form of footwear such as running shoes, jogging shoes, tennis, squash or racquetball shoes, basketball shoes, sandals and flippers, the disclosures herein may be applied to a wide range of footwear or possibly other kinds of articles.

For consistency and convenience, directional adjectives are employed throughout this detailed description corresponding to the illustrated embodiments. The term "longitudinal direction" as used throughout this detailed description and in the claims refers to a direction extending from heel to toe, which may be associated with the length, or longest dimension, of an article of footwear such as a sports or recreational shoe. Also, the term "lateral direction" as used throughout this detailed description and in the claims refers to a direction extending from side to side (lateral side and medial side) or the width of an article of footwear. The lateral direction may generally be perpendicular to the longitudinal direction. The term "vertical direction" as used with respect to an article of footwear throughout this detailed description and in the claims refers to the direction that is normal to the plane of the sole of the article of footwear. Moreover, the vertical direction may generally be perpendicular to both the longitudinal direction and the lateral direction.

The present disclosure describes to an article of footwear and a method of manufacturing the same. The presently disclosed manufacturing method allows tuning of the fit and cushioning of the article of footwear. In certain embodiments, the method includes (a) providing a sole structure in a relaxed state that includes apertures, wherein the apertures are arranged in an auxetic configuration; (b) placing the sole structure under tension such that the sole structure undergoes auxetic expansion; and (c) attaching an upper to the sole structure while the sole structure is under tension. The sole structure, which has an auxetic configuration, compresses the upper after it is attached. As a consequence, when a foot is inserted in the article of footwear, the upper expands, and the sole structure does a better job contouring to the foot during expansion than if the upper was merely draped. Therefore, the article of footwear promotes a better fit, feel, and more fully engages the auxetic qualities of the sole structure than other articles of footwear. The method may further include releasing tension from the sole structure such that the sole structure returns to the relaxed state. The method may further include providing a last. The last has a lower last surface with a lower last surface area, and the sole structure has a last contacting surface with an interior surface area. The lower last surface area of the last may be greater than the interior surface area of the last contacting surface of the sole structure when the sole structure is in the relaxed state. The interior surface area of the last contacting surface may be equal to the lower last surface area when the sole structure is tensioned.

The method may further include attaching the upper to the sole structure while the sole structure is tensioned to form an article. The article may define a cavity with a tensioned volume while the sole structure is tensioned. The method may further include removing the article from the last such that the sole structure reverts to the relaxed state. The cavity has a relaxed volume when the sole structure is in the relaxed state, and the relaxed volume may be less than the tensioned volume. Placing the sole structure under tension may include applying tension laterally across the sole structure. The laterally applied tension may cause the sole structure to expand both laterally and longitudinally. The sole structure has a first length and a first width in the relaxed state. The sole structure has a second length and a second width in a tensioned state. The second width may be greater than the first width, and the second length may be greater than the first length.

In some embodiments, the method of manufacturing an article of footwear includes: (1) forming a sole structure with apertures, wherein the apertures are spaced in an auxetic configuration, and the sole structure has a first sole length and a first sole width; (b) providing a last with a lower surface, the last including a last length and a last width, wherein the first sole length is less than the last length, the first sole width is less than the last width; (c) tensioning the sole structure laterally such that the sole structure expands both laterally and longitudinally, wherein the tensioned sole structure has a second sole length and a second sole width, the second sole length is greater than the first sole length, and the second sole width is greater than the first sole width; (d) disposing the tensioned sole structure on the lower surface of the last; and (e) attaching an upper to the tensioned sole structure. The method may further include removing the upper and the sole structure from the last. The sole structure reverts to having the first sole length and the first sole width after being removed from the last. The sole structure may be formed of foam. The upper includes apertures, and the apertures are arranged in an auxetic configuration. While the sole structure is tensioned, the apertures of the sole structure may be substantially the same size as the apertures of the upper while the upper is tensioned. While the sole structure is tensioned, the apertures of the sole structure may be larger than the apertures of the upper while the upper is tensioned. The upper that is attached to the sole structure may form an article located on the last. The article has a cavity, and the cavity having a tensioned volume while the article is on the last. The method may further include removing the article from the last such that the sole structure reverts to the first sole width and first sole length. The cavity has a relaxed volume, and the relaxed volume may be less than the tensioned volume.

The present disclosure also describes an article of footwear. In some embodiments, the article includes an upper and a sole structure attached to the upper. Each of the upper and the sole structure defines a plurality of apertures arranged in an auxetic configuration. When worn by a user, the sole structure is configured to expand auxetically, and the upper is also configured to expand auxetically. The sole structure has a first thickness when the sole structure is in a neutral state. The sole structure has a second thickness when the sole structure is subjected to a lateral force, and the first thickness and the second thickness may be substantially similar. When the upper and the sole structure are subjected to a force of the same magnitude, both the upper and the sole structure may be configured to expand at a substantially similar rate. When the upper and the sole structure are subjected to a force of the same magnitude, the upper may expand at a greater rate than that of the sole structure.

FIG. 1 is a bottom view of sole structure 100. In some embodiments, sole structure 100 may be configured to provide traction for an article of footwear. In addition to providing traction, sole structure 100 may attenuate ground reaction forces when compressed between the foot and the ground during walking, running, or other ambulatory activities. The configuration of sole structure 100 may vary significantly in different embodiments. In some cases, the configuration of sole structure 100 can be configured according to one or more types of ground surfaces on which sole structure 100 may be used. Examples of ground surfaces include, but are not limited to, natural turf, synthetic turf, dirt, hardwood flooring, as well as other surfaces.

Sole structure 100 may include at least one layer made of an auxetic structure. This layer can be referred to as an "auxetic layer" (or "reactive layer"). When the person wearing an article of footwear that incorporates sole structure 100 engages in an activity, such as running, turning, leaping or accelerating, that puts the auxetic layer under increased longitudinal or lateral tension, the auxetic layer increases in length and width and thus provides improved traction. This expansion of the auxetic material may also help to absorb some of the impact with the playing surface. Although the descriptions below only discuss a limited number of types of footwear, embodiments can be adapted for many sport and recreational activities, including tennis and other racquet sports, walking, jogging, running, hiking, handball, training, running or walking on a treadmill, as well as team sports such as basketball, volleyball, lacrosse, field hockey, and soccer.

In some embodiments, sole structure 100 may include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction). Sole structure 100, as shown particularly in FIGS. 1 and 2 and as described further in detail below, has an auxetic structure or configuration. Sole structures comprising auxetic structures are described in Cross, U.S. Patent Application Publication No. 2015/0075033, published Mar. 19, 2015 and entitled "Auxetic Structures and Footwear with Soles Having Auxetic Structures" (the "Auxetic Structures application"), the entirety of which is hereby incorporated by reference.

Figure 2:
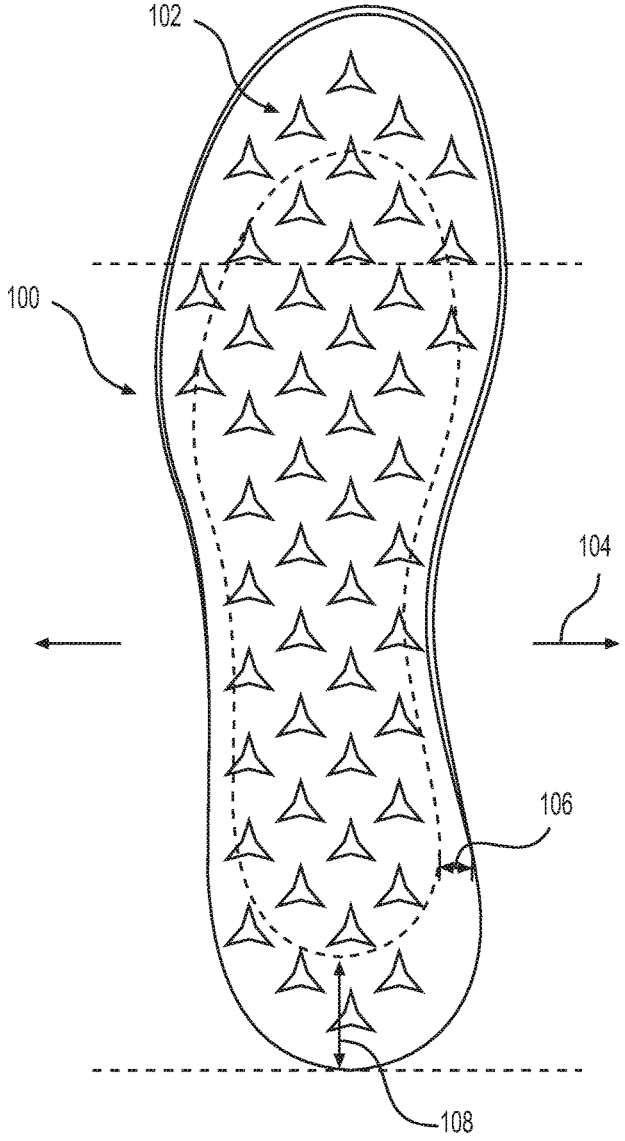
FIG. 2 is a schematic view of the embodiment of the sole structure of FIG. 1 in a tensioned state.

As described in the Auxetic Structures application, auxetic materials have a negative Poisson's ratio, such that when they are under tension in a first direction their dimensions increase both in the first direction and in a second direction orthogonal or perpendicular to the first direction. This property of an auxetic material or structure is illustrated in FIGS. 1 and 2.

As shown in FIG. 1, sole structure 100 may include a plurality of apertures. Plurality of apertures 102 may be configured to provide an auxetic effect or auxetic action. That is, when sole structure 100 is subjected to a lateral force, sole structure 100 may extend laterally as well as longitudinally. As shown in FIG. 2, sole structure 100 is subjected to lateral force 104. When subjected to lateral force 104, sole structure 100 extends lateral distance 106 as well as longitudinal distance 108. Due to the geometric configuration of plurality of apertures 102, sole structure 100 extends along an axis parallel to lateral force 104 as well as along an axis perpendicular to lateral force 104. As shown, each aperture of plurality of apertures 102 expands laterally and longitudinally. The expansion of the apertures in turn causes sole structure 100 to also expand laterally and longitudinally. This action may be referred to as auxetic expansion. It should be recognized that the opposite, auxetic contraction, may also be possible. That is, during auxetic contraction, when sole structure 100 is subjected to a compressive lateral force, lateral distance 106 as well as longitudinal distance 108 may be decreased. As a non-limiting example, one or more of the apertures 102 may have a simple isotoxal star-shaped polygonal shape.

In some embodiments, a sole structure may be designed to have a first dimension when at rest and a second dimension when subjected to a force. In some embodiments, altering the size of apertures within the sole structure may assist in determining or setting the amount of stretch that the sole structure will experience when subjected to a force. That is, by changing the size of the apertures, the percentage change in the cross-sectional area encompassed by a sole structure when subjected to a tensile force may be altered. As shown in FIG. 1, plurality of apertures 102 may be narrow or small. In some embodiments, such as depicted in FIG. 1, plurality of apertures 102 may be slits in sole structure 100. Narrower apertures may be configured to stretch to a greater degree than larger apertures. That is because the percentage difference in cross-sectional area between a narrow aperture in an untensioned or relaxed state compared to the narrow aperture in a tensioned state is greater than the percentage difference in cross-sectional area of a larger aperture in an untensioned or neutral state as to a larger aperture in a tensioned state.

In some embodiments, plurality of apertures 102 may be particularly sized in a relaxed state such that when subjected to a force that the stretched sole structure 100 will be a second particular size. For example, in some embodiments, each aperture of plurality of apertures 102 may be sized such that when pulled or stretched a particular distance that plurality of apertures 102 may be a particular size. More specifically, for example, when sole structure 100 is stretched a quarter of an inch, plurality of apertures 102 may have a cross-sectional area of approximately one-quarter inch squared. By changing the size of plurality of apertures 102 in a relaxed state, the size of the plurality of apertures 102 in a tensioned state may therefore be altered. The desired size of each aperture of plurality of apertures 102 when tensioned may therefore be used to size plurality of apertures 102 in a relaxed state. Additionally, utilizing smaller-sized or larger-sized apertures in a relaxed state will also influence the size of apertures in a tensioned state.

In some embodiments, the size and shape of plurality of apertures 102 may be particularly formed to achieve various properties within a sole structure. In some embodiments, plurality of apertures 102 may be sized such that when an article of footwear that utilizes sole structure 100 is put on a foot of a user, plurality of apertures 102 may be relatively large. That is, in some embodiments, when worn by a user such that sole structure 100 stretches, plurality of apertures 102 may encompass a large percentage of sole structure 100. In such embodiments, sole structure 100 may be able to bend or twist to a greater extent than in embodiments with smaller apertures. This is because a sole structure with less material may be able to bend to a greater degree than a sole structure with a greater amount of the same material. When stretched, the same amount of material of sole structure 100 is spread over a larger cross section when compared to sole structure 100 in a tensioned state. In other embodiments, plurality of apertures 102 may be designed such that when worn by a user, a smaller percentage of sole structure 100 is occupied by the apertures. In such an embodiment, sole structure 100 may resist bending or twisting to a greater degree than in embodiments with a larger area occupied by apertures. An embodiment may utilize a design with a smaller percentage of sole structure 100 occupied by the apertures to allow for support and stability while also including a sole structure with auxetic properties.

The embodiments described herein can make use of any of the apparatus or structures described in Cross, U.S. Patent Application Publication No. 2015/0075033, published Mar. 19, 2015 and entitled "Auxetic Structures and Footwear with Soles Having Auxetic Structures. In Cross et al., many different auxetic structures are discussed with varying thicknesses, material compositions, and geometries relating to sole structures. Further, the embodiments described herein can also make use of apparatus or structures described in Hull, U.S. patent application Ser. No. 13/774,186, U.S. Patent Application Publication No. 2014/0237850, the entirety of which is hereby incorporated by reference. In Hull, auxetic material is used in conjunction with inelastic material in the formation of straps.

Figure 3:
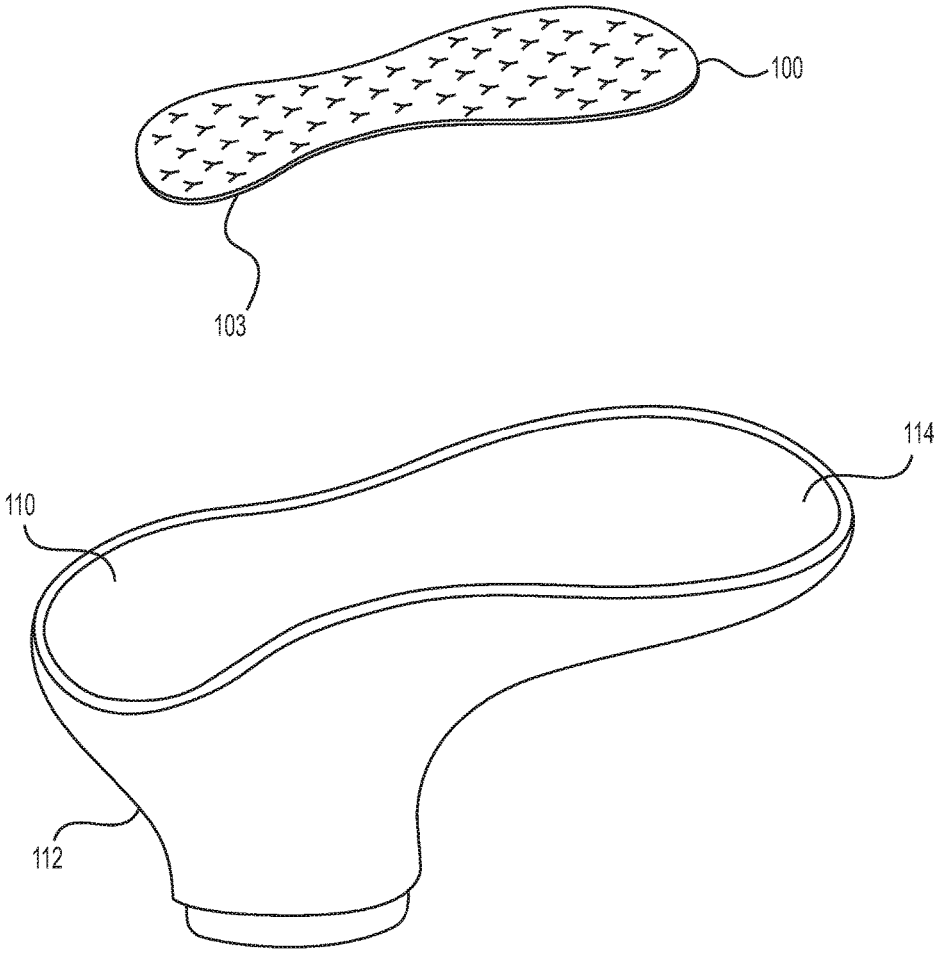
FIG. 3 is a schematic view of an embodiment of a sole structure and a last.

Referring now to FIGS. 3-6, a method of forming an article of footwear is depicted. Referring particularly to FIG. 3, sole structure 100 and last contacting surface 103 are spaced from last 110 (e.g., a shoe last). In the embodiment as depicted, upper 112 may be positioned around a portion of last 110. Upper 112 may be formed of various materials including knit material, woven or non-woven material as well as foam, polyurethane materials, and other materials. In some embodiments, upper 112 may be prepared to receive sole structure 100. For example, in some embodiments, upper 112 may include an adhesive that is applied along the edge of upper 112. In further embodiments, upper 112 may extend completely around lower surface 114 of last 110. In such embodiments, upper 112 may appear sock-like. In embodiments in which upper 112 extends along lower surface 114 of last 110, an adhesive such as a glue may be applied along the portion of upper 112 that covers lower surface 114 of last 110.

In some embodiments, the flexibility and/or stretchiness of upper 112 may vary. In some embodiments, upper 112 may be designed to have little stretch, whereas in other embodiments upper 112 may be designed to have significant stretch, such that in one or more directions a dimension along said direction may be increased by several or more percent of its unstretched length. The properties of upper 112 may be altered or chosen based on the intended fit of the article. For example, in an embodiment that includes a flexible sole structure, upper 112 may also be flexible to complement the properties of the sole structure. Additionally, upper 112 may be rigid or less flexible to provide stability to an article of footwear.

Figure 4:
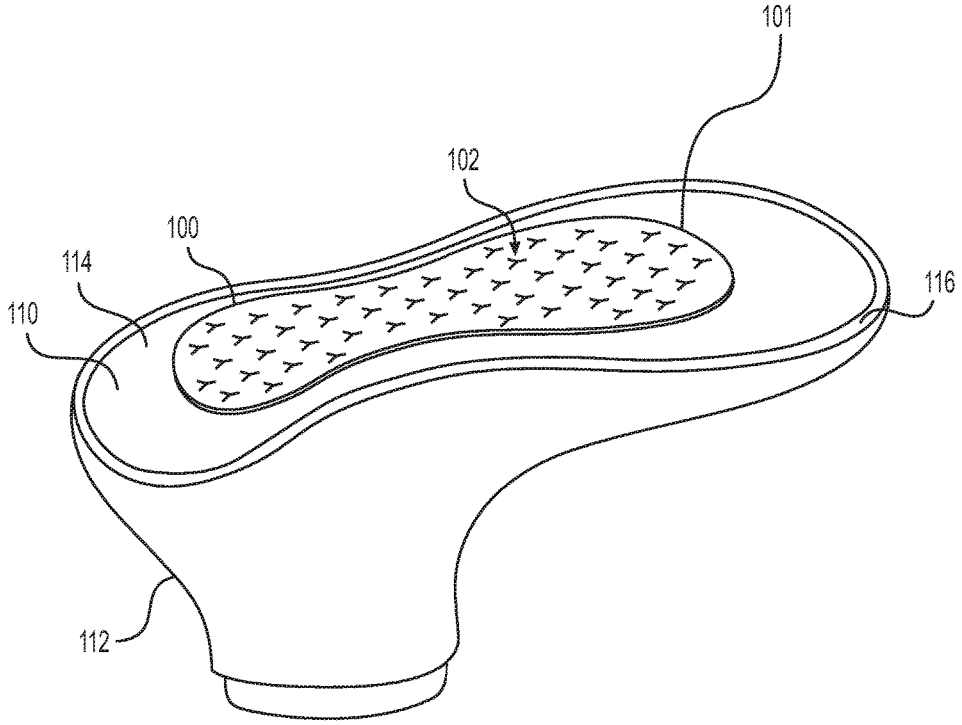
FIG. 4 is a schematic view of an embodiment of a sole structure positioned adjacent to a last.

Referring now to FIG. 4, sole structure 100 is shown positioned along lower surface 114 of last 110. For example, the sole structure 100 may be directly disposed on the lower surface 114 of last 110. As shown, sole structure 100 is in a relaxed, neutral, or untensioned state such that plurality of apertures 102 are closed or are constricted compared to the tensioned state. In such a state, as can be seen, sole structure 100 does not extend to edge 116 of upper 112 laterally or medially. That is, sole structure 100 is smaller or shorter longitudinally and laterally than last 110. Therefore, the area of the last contacting surface of sole structure 100 may be less than the area of lower surface 114 of last 110. In some embodiments, in an untensioned or relaxed state, sole structure 100 may be near the full width and length of last 110, whereas in other embodiments, in an untensioned state, sole structure 100 may be 10 percent to 60 percent shorter or smaller laterally and/or longitudinally than last 110. In other embodiments, in an untensioned state, sole structure 100 may be between 1 percent and 10 percent shorter or smaller laterally and/or longitudinally than last 110.

Figure 5:
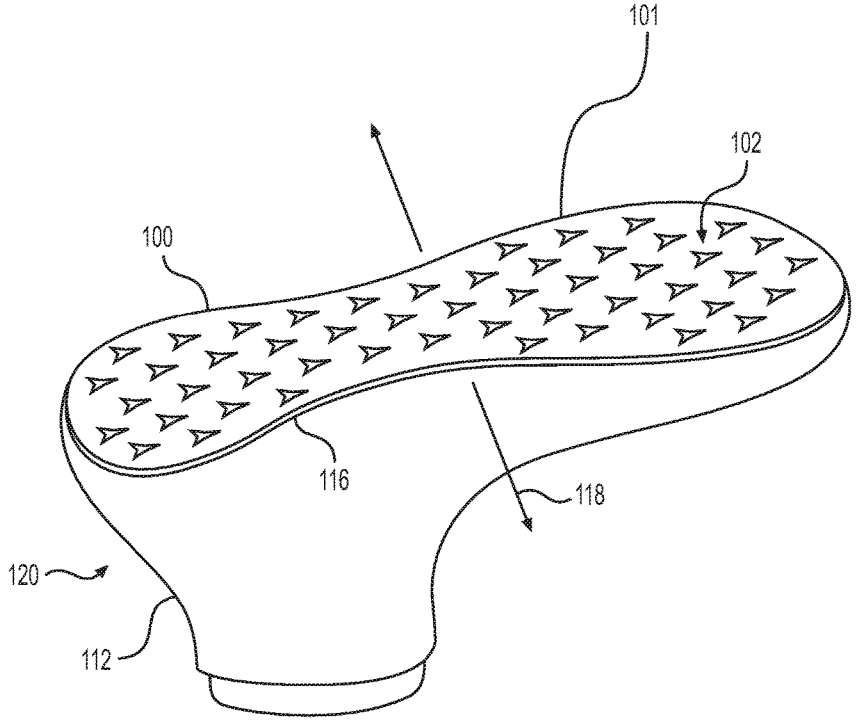
FIG. 5 is schematic view of an embodiment of a tensioned sole structure positioned adjacent to a last.

Referring now to FIG. 5, sole structure 100 may be subjected to tensile force 118. As shown, as sole structure 100 is subjected to tensile force 118, plurality of apertures 102 enlarge. Because plurality of apertures 102 enlarge, the size of sole structure 100 may also enlarge. As shown in FIG. 5, sole structure 100 may undergo auxetic expansion and extend laterally as well as longitudinally when subjected to a lateral force. In the configuration as shown, sole structure 100 now aligns with edge 116 of upper 112 along the medial side and lateral side as well as along the heel and forefoot portions of upper 112. As shown, sole structure 100 now occupies a greater percentage of the surface area of lower surface 114. It should be recognized that, when stretched, the material that forms sole structure 100 may stretch; however, auxetic expansion accounts for a substantial majority of the change in surface area occupied by sole structure 100 in a tensioned configuration.

In some embodiments, an interior area of sole structure 100 may be altered when sole structure 100 is tensioned. As discussed herein, "interior area" refers to an area within the bounds of a given item that defines the overall shape of the item. For example, perimeter 101 defines the bounds of sole structure 100. Sole structure 100, as shown in FIG. 4, may have a smaller interior area than sole structure 100, as shown in FIG. 5, because perimeter 101 encompasses less area in the untensioned or relaxed state compared to the tensioned state. Therefore, last contacting surface 103 may encompass a smaller interior area in an untensioned state as compared to a tensioned state.

In some embodiments, upper 112 may be secured to sole structure 100 while sole structure 100 is tensioned. Upper 112 may be secured to sole structure 100 using an adhesive or upper 112 may be secured using other techniques. For example, in some embodiments, upper 112 may be stitched or sewn to sole structure 100, while in further embodiments, upper 112 may be secured to sole structure 100 using needles, pins, tacks, or other devices. Once sole structure 100 is secured to upper 112, article of footwear 120 may be formed.

Figure 6:
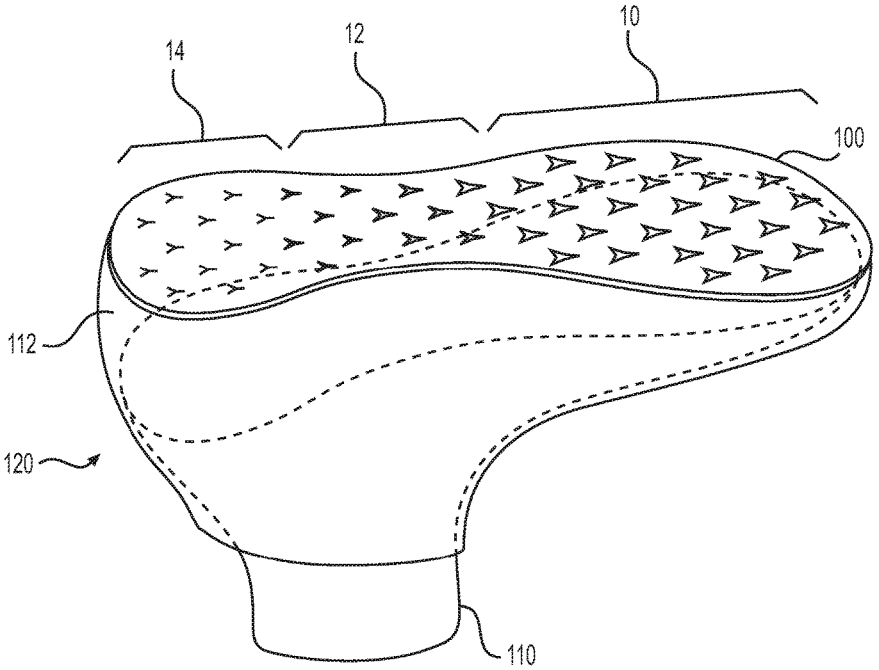
FIG. 6 is a schematic view of an embodiment of an article of footwear being removed from a last.

Referring now to FIG. 6, article of footwear 120, also referred to simply as article 120, may be removed from last 110. In some embodiments, sole structure 100 may be particularly designed to accommodate additional stretch when removing article 120 from last 110. As article 120 is removed, additional tensile force may be applied to sole structure 100, thereby further expanding sole structure 100 and assisting in the removal of article 120 from last 110. By designing additional stretch accommodations into sole structure 100, it may be easier to remove article 120 from last 110 as compared to articles of footwear that do not include additional stretch accommodations in the sole structure. As article 120 is removed, various portions of sole structure 100 may compress to the relaxed or neutral state. For example, heel region 14 of sole structure 100 may include apertures that are fully closed, whereas forefoot region 10 of sole structure 100 may include almost fully extended apertures. Additionally, midfoot region 12 may include apertures that are partially closed. As article 120 is removed from last 110, the force or tension provided by last 110 to sole structure 100 may be removed, thereby allowing sole structure 100 to revert to a relaxed state. The article of footwear may be tuned using auxetic structures. With the auxetic structures, the ride, fit, and cushioning across the sole structure can be customized. Such customization is generally not possible when using a monolithic rubber or foam sole. The heel region 14 is configured to absorb energy, while providing lateral stability. The midfoot region 12 can be stiffer than the heel region 14 and/or non-auxetic, because the foot exerts very little contact pressure at the midfoot portion 12 when compared with the heel region 14. The forefoot region 10 has enough firmness and structure to enable a good/firm push-off without needing to dig out of a mushy cushion.

Figure 7:
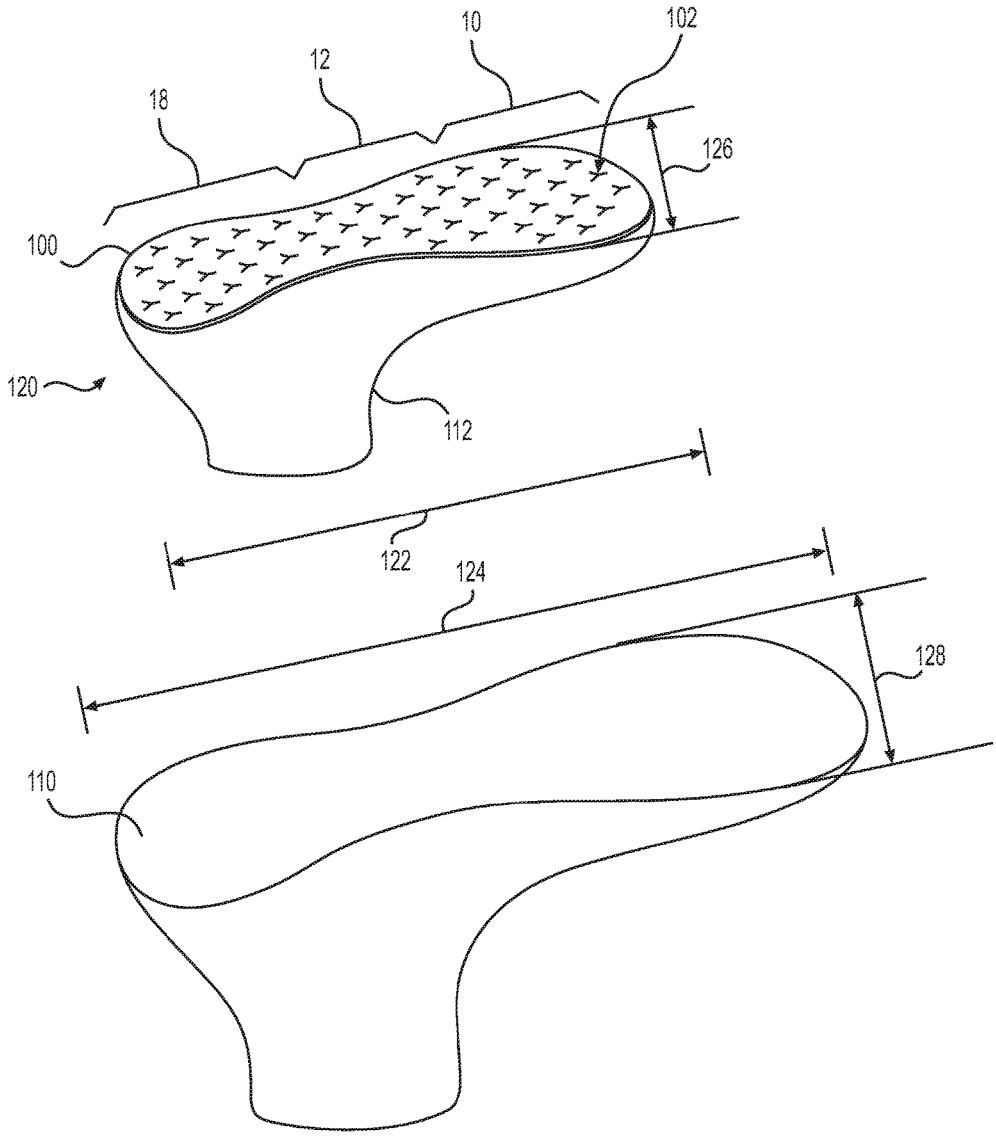
FIG. 7 is a schematic view of an embodiment of an article of footwear separate from a last.

Referring now to FIG. 7, article 120 has been removed from last 110. As shown, length 122 of sole structure 100 is shorter than length 124 of last 110. Because force has been released from sole structure 100, plurality of apertures 102 of sole structure 100 are collapsed or closed in the relaxed state of sole structure 100 causing the length of sole structure 100 may be reduced. Additionally, width 126 of sole structure 100 is less than width 128 of last 110. Because plurality of apertures 102 are arranged in an auxetic configuration, when sole structure 100 reduces in length, sole structure 100 may also reduce in width. Once article 120 is removed from last 110, last 110 no longer restricts sole structure 100 from returning to the relaxed form of sole structure 100.

Figure 8:
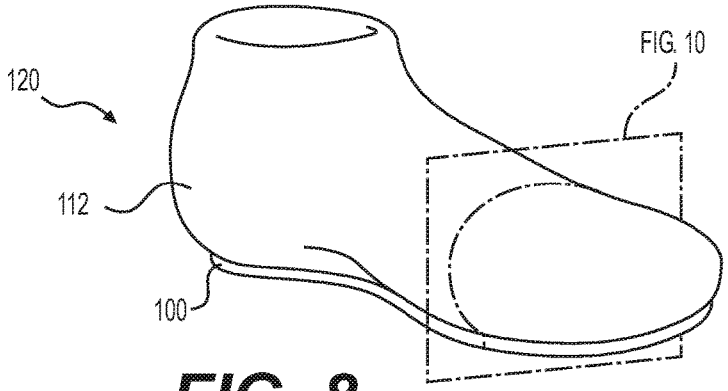
FIG. 8 is an isometric view of an embodiment of an article of footwear in a relaxed state.
Figure 9:
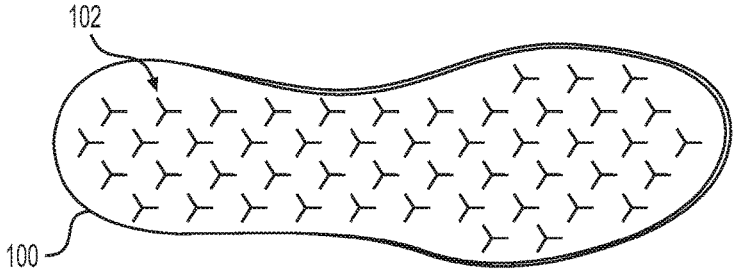
FIG. 9 is a bottom view of the article of footwear of FIG. 8 in a relaxed state.
Figure 10:
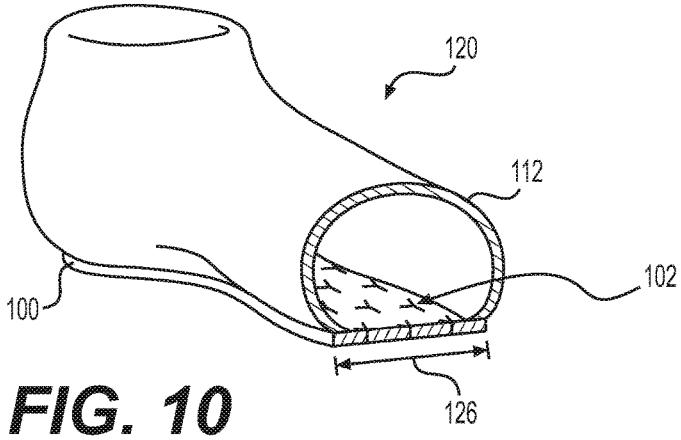
FIG. 10 is an isometric cutaway view of the article of footwear from FIG. 8 in a relaxed state.
Figure 11:
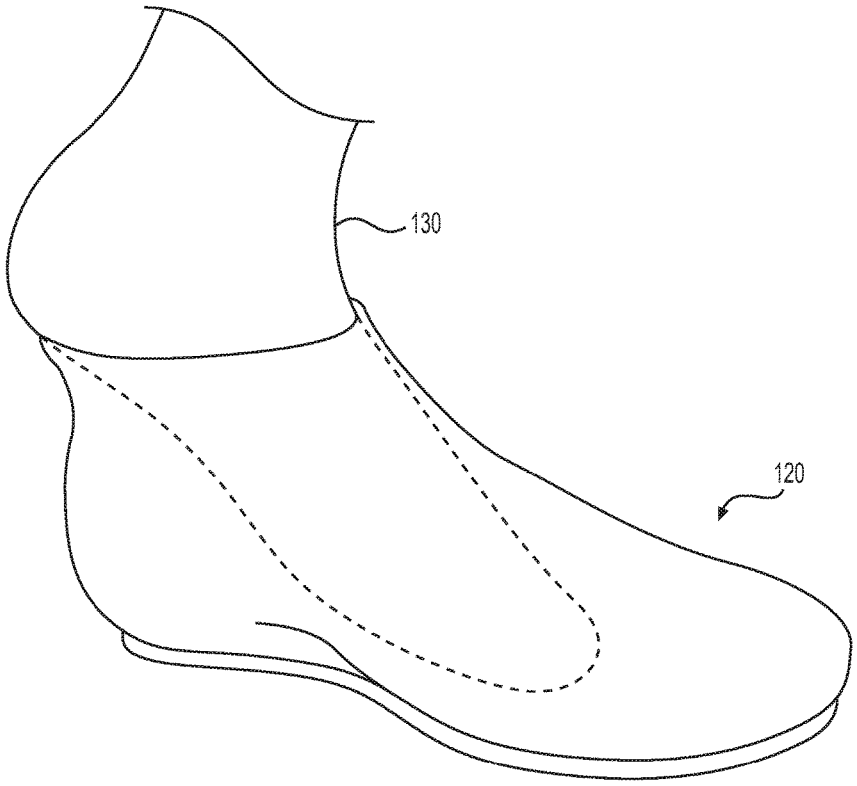
FIG. 11 is a schematic view of a foot being inserted into the article of footwear of FIG. 8.
Figure 12:
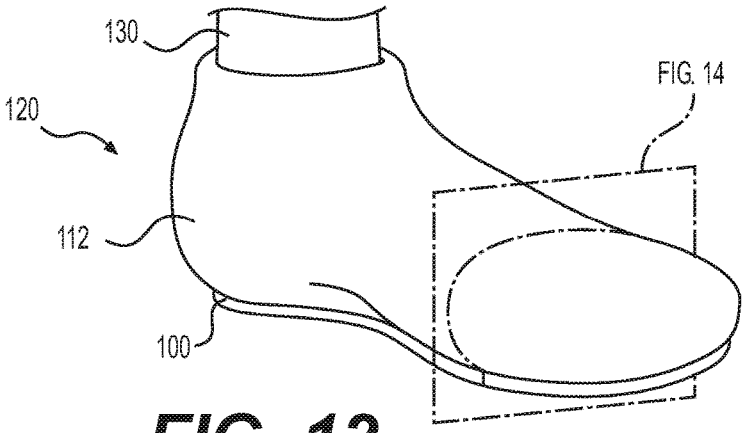
FIG. 12 is an isometric view of an article of footwear with a foot inserted into the article of footwear.

Referring now to FIGS. 8-14, various views of an article of footwear are shown in a relaxed state and when worn or used by a user. Referring particularly to FIGS. 8-10, various views are depicted of article 120 at rest or in a relaxed state. FIG. 9 depicts sole structure 100 in a relaxed or untensioned state. Although sole structure 100 is attached to upper 112, sole structure 100 may revert to a shape and size similar to the shape and size of sole structure 100 prior to sole structure 100 being attached to upper 112. In other embodiments, upper 112 may be stiffer or more rigid such that upper 112 may resist or restrain sole structure 100 such that sole structure 100 is not able to return to a completely relaxed configuration.

Referring now to FIG. 10, a cross-sectional view of article 120 is depicted. As shown, plurality of apertures 102 of sole structure 100 are narrow, which in turn causes sole structure 100 to have width 126 that is also narrow. Because upper 112 is adhered to sole structure 100 when sole structure 100 is under tension from last 110, when the tension is removed, upper 112 may include a surplus of material. In some embodiments therefore, upper 112 may form a bulbous structure when article 120 is in a relaxed state. The figure is meant to be representative and does not necessarily depict the amount of extra material that may be present.

FIGS. 11-14 depict article 120 with foot 130 of a user being inserted into article 120. As foot 130 is inserted into article 120, sole structure 100 may stretch in an auxetic manner to accommodate foot 130. In some embodiments, foot 130 may be longer longitudinally than sole structure 100. In such embodiments, sole structure 100 may expand longitudinally thereby accommodating the length of foot 130. Similarly, in some embodiments, foot 130 may be wider laterally than sole structure 100. In such embodiments, sole structure 100 may expand laterally thereby accommodating the width of foot 130.

Figure 13:
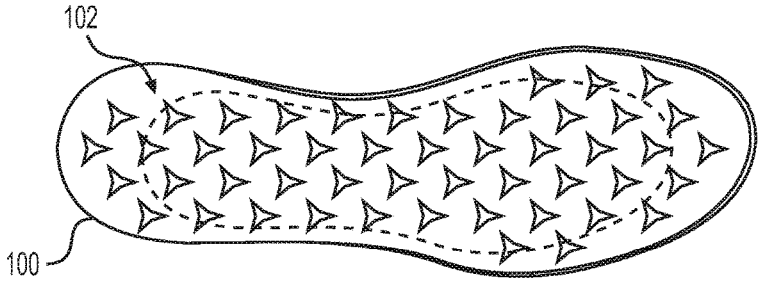
FIG. 13 is a bottom view of the article of footwear shown in FIG. 12.
Figure 14:
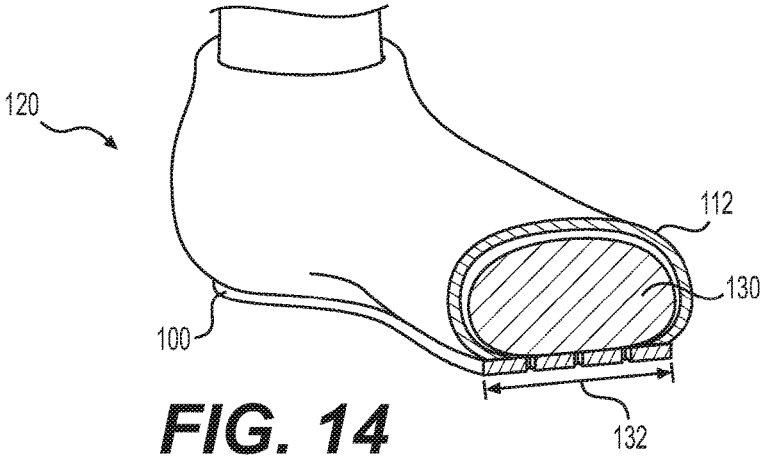
FIG. 14 is an isometric cutaway view of the article of footwear of FIG. 12.

Referring particularly to FIGS. 13 and 14, the change in width and length of sole structure 100 is clearly depicted. The dotted line shown in FIG. 13 is representative of sole structure 100 when sole structure 100 is not subjected to a force, such as shown in FIG. 9. In FIG. 13, sole structure 100 has been stretched by foot 130 such that sole structure 100 extends laterally and longitudinally. Additionally, as shown in FIG. 14, width 132 of sole structure 100 may be larger than width 126 shown in FIG. 10. As foot 130 presses against upper 112 of article 120, upper 112 may pull against sole structure 100. This pulling or tensioning of sole structure 100 may cause plurality of apertures 102 within sole structure 100 to expand, thereby expanding sole structure 100.

In some embodiments, the design of sole structure 100 may increase comfort or fit of article 120. Because sole structure 100 may expand to accommodate a foot, the fit of article 120 may be more comfortable or exact when compared to other embodiments without sole structure 100. As a foot presses against upper 112, sole structure 100 expands to accommodate the shape or size of foot 130. Upper 112 may be snug against foot 130 due to the accommodation of sole structure 100 to the size of foot 130.

In other embodiments, a sole structure may be designed such that it is compressed before being attached to an upper. That is, in some embodiments, the sole structure may be larger when in the relaxed state and compressed before attaching to an upper. In such embodiments, the apertures may be larger in the relaxed state than as depicted in the previous embodiment. Once compressed, the sole structure would reduce in size laterally and longitudinally in order to align with the upper around a last. This technique would provide a sole structure that is larger in the relaxed state.

Figure 15:
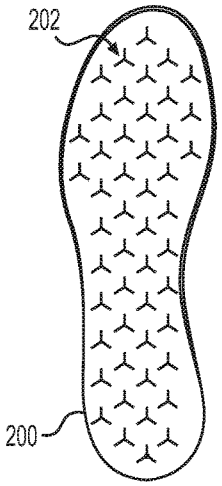
FIG. 15 is a schematic view of an embodiment of a sole structure with auxetic apertures in a relaxed state.

Referring now to FIGS. 15-18, an alternate embodiment of portions of an article of footwear is depicted. FIG. 15 depicts sole structure 200 in an untensioned or relaxed state. In some embodiments, sole structure 200 may have a similar composition to that of sole structure 100 described previously. In other embodiments, sole structure 200 may be formed of a different material, thickness, size, or shape. Sole structure 200 may include plurality of apertures 202. In some embodiments, plurality of apertures 202 may have an auxetic shape or may be arranged in an auxetic configuration as discussed previously with regard to sole structure 100. That is, plurality of apertures 202 may be shaped such that when sole structure 200 is subjected to a tensile force laterally, sole structure 200 may extend both laterally and longitudinally. Additionally, when sole structure 200 is compressed laterally, sole structure 200 may reduce in width as well as in length. For example, one or more of the apertures 202 may have a simple isotoxal star-shaped polygonal shape.

Figure 16:
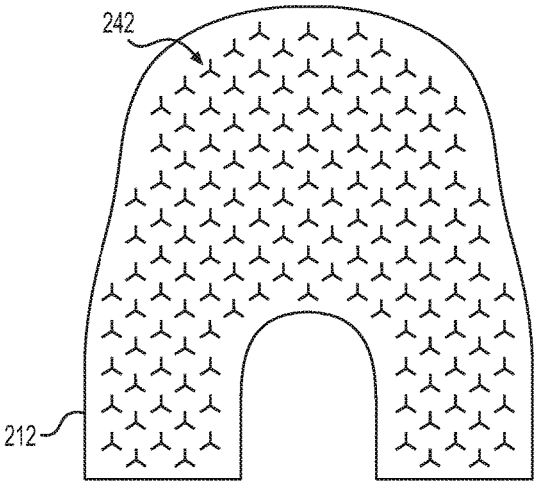
FIG. 16 is a schematic view of an embodiment of an upper with auxetic apertures in a relaxed state.

As shown in FIG. 16, upper 212 is depicted including plurality of apertures 242. In some embodiments, upper 212 may be formed of the same material as sole structure 200. In other embodiments, upper 212 may be formed of other various materials. For example, in some embodiments, upper 212 may be formed of a woven material, non-woven material, or knit material. In other embodiments, upper 212 may be formed of a polyurethane material or foam as well as other materials.

Figure 17:
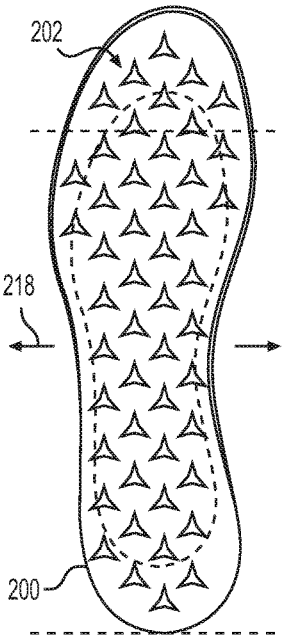
FIG. 17 is a schematic view of the sole structure of FIG. 15 in a tensioned state.
Figure 18:
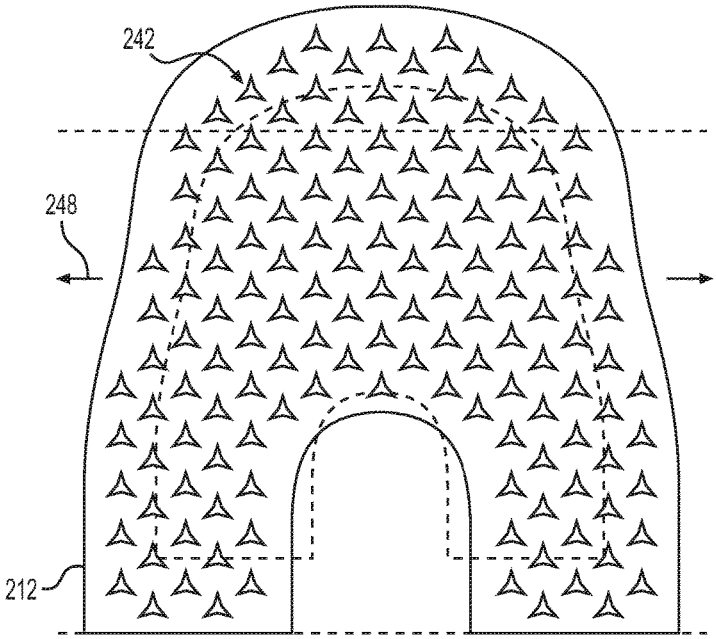
FIG. 18 is a schematic view of the upper of FIG. 16 in a tensioned state.

Referring now to FIGS. 17 and 18, sole structure 200 is subjected to tensile force 218 while upper 212 is subjected to tensile force 248. In a similar manner as sole structure 100, sole structure 200 and upper 212 may expand. When subjected to tensile force 218 along a lateral axis, sole structure 200 may expand laterally as well as longitudinally. In a similar manner, when subjected to tensile force 248 along a lateral axis, upper 212 may expand or extend laterally as well as longitudinally. As discussed previously, because upper 212 and sole structure 200 include apertures arranged in an auxetic configuration, both upper 212 and sole structure 200 may extend along a direction parallel to the direction of a tensile force as well as along a direction perpendicular to the direction of a tensile force. The apertures of sole structure 200 and upper 212 may expand in a manner as discussed previously with reference to sole structure 100. That is, plurality of apertures 202 and plurality of apertures 242 may expand in an auxetic manner.

Figure 19:
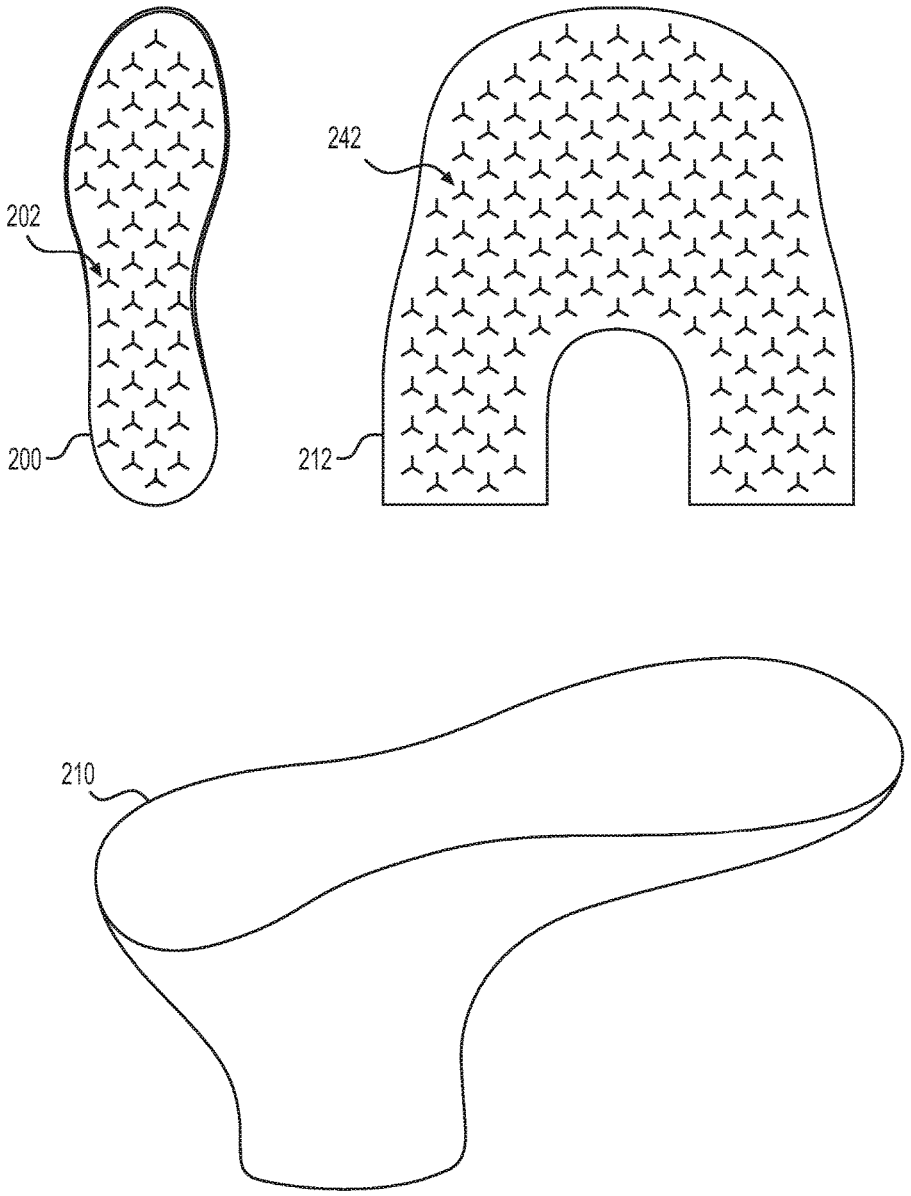
FIG. 19 is a schematic view of an embodiment of a relaxed upper and a relaxed sole structure along with a last.

Referring now to FIG. 19, sole structure 200, upper 212, and last 210 are depicted. In this view, sole structure 200 and upper 212 are in a relaxed or untensioned state. As shown, therefore, plurality of apertures 202 and plurality of apertures 242 are in a closed or relaxed state. As discussed previously with reference to sole structure 100, plurality of apertures 202 and plurality of apertures 242 may be various shapes and sizes. That is, although depicted as slits or narrow apertures, plurality of apertures 202 and plurality of apertures 242 may be larger or more open than as depicted in FIG. 19. By changing the size of plurality of apertures 202 and plurality of apertures 242 in a relaxed state, the flexibility and fit of an article using sole structure 200 and upper 212 may be altered.

In some embodiments, an upper may be sized such that it is necessary to stretch the upper when wrapping the upper around a last. As shown in FIG. 19, upper 212 may be sized such that in order to wrap upper 212 around last 210 it may be necessary to stretch upper 212 thereby expanding plurality of apertures 242. That is, in some embodiments, in a relaxed or untensioned state, upper 212 may be smaller than required to wrap around last 210 and form an article of footwear. In some embodiments, upper 212 may be particularly sized such that when stretched, upper 212 may extend vertically, laterally, and longitudinally to particular areas along last 210.

Figure 20:
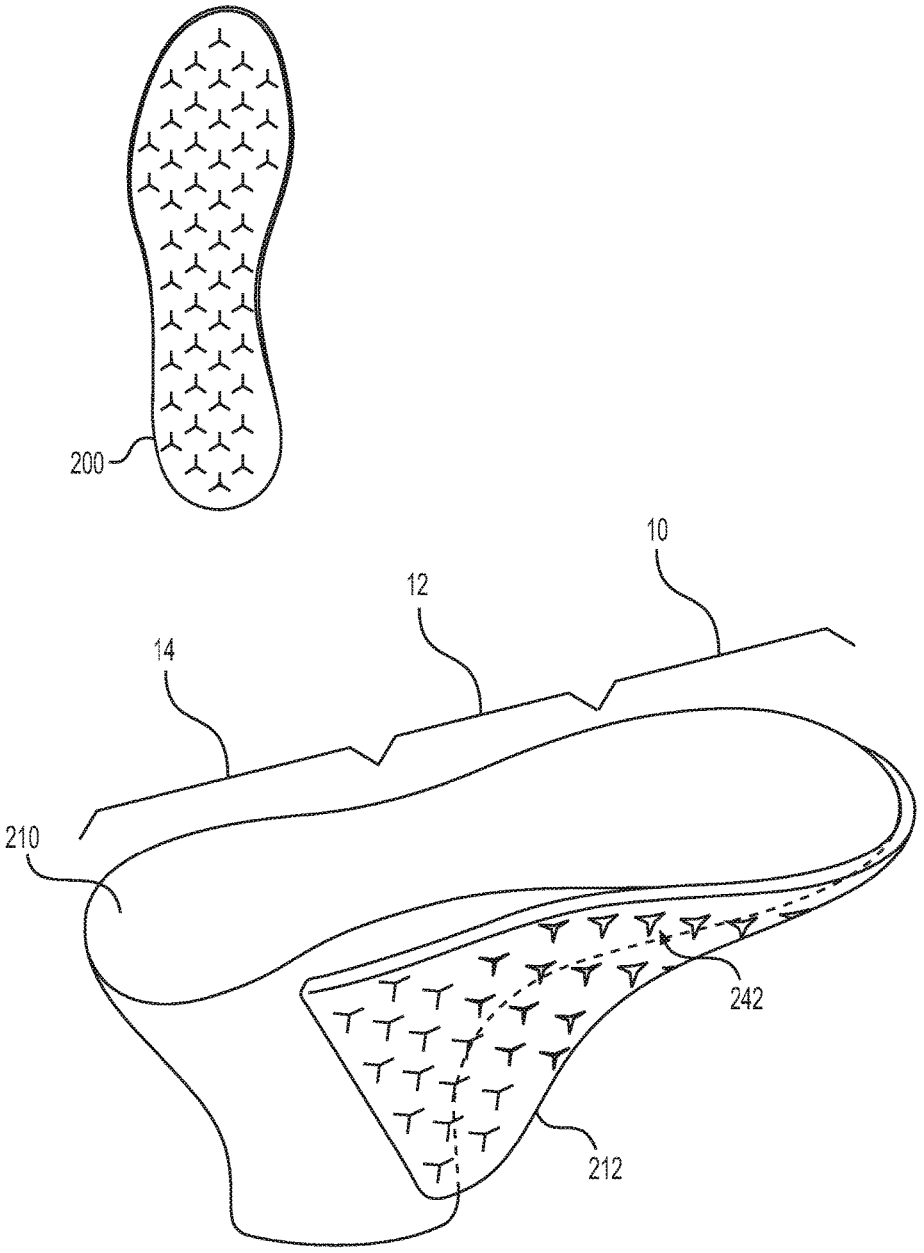
FIG. 20 is a schematic view of the upper being wrapped around the last.

Referring now to FIG. 20, upper 212 is shown being wrapped around last 210. As upper 212 is wrapped around last 210, various portions of upper 212 may begin to stretch. As shown, for example, plurality of apertures 242 in forefoot region 10 may be stretched to a greater degree than plurality of apertures 242 toward midfoot region 12. As upper 212 is pressed, pulled, and stretched around last 210, plurality of apertures 242 may expand and thereby increase the size of upper 212.

Figure 21:
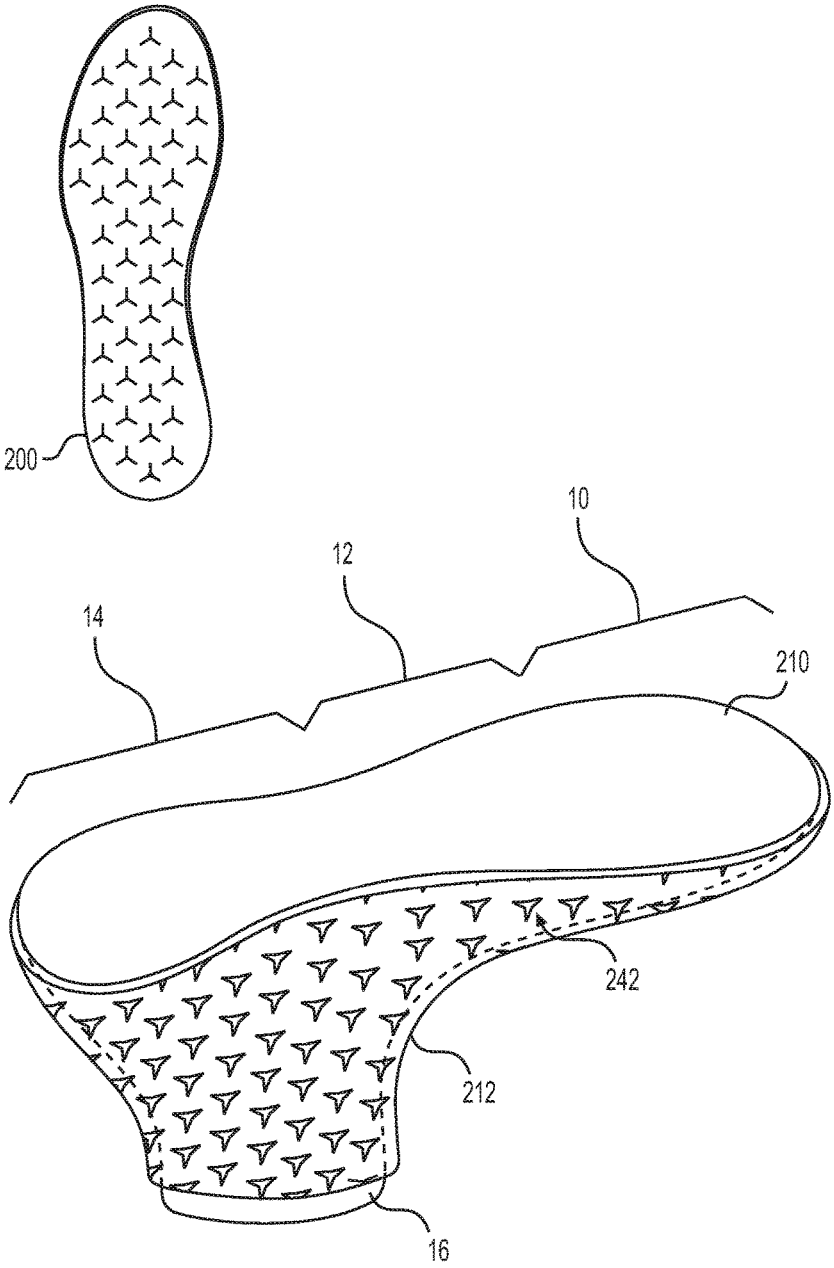
FIG. 21 is a schematic view of the upper secured to the last.

Referring now to FIG. 21, upper 212 may be secured around last 210. As shown, plurality of apertures 242 may expand in an auxetic manner. Because upper 212 may be folded or twisted while being wrapped around last 210, upper 212 may be in a three-dimensional orientation. This orientation may allow for upper 212 to extend vertically (for example, along ankle region 16 of last 210), as well as laterally and longitudinally. The location and orientation of upper 212 may be specifically designed to stretch a particular amount laterally, longitudinally, and vertically. By particularly placing apertures, and particularly sizing the apertures, the location and size of upper 212 on last 210 may be particularly located.

Figure 22:
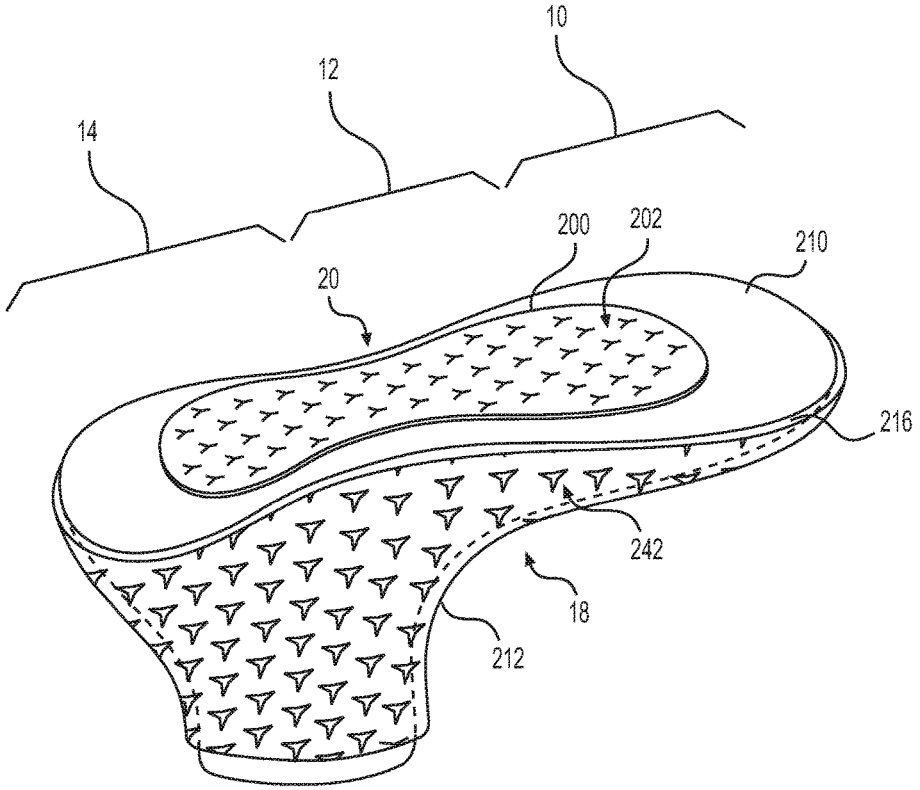
FIG. 22 is a schematic view of the sole structure being positioned adjacent to the last.
Figure 23:
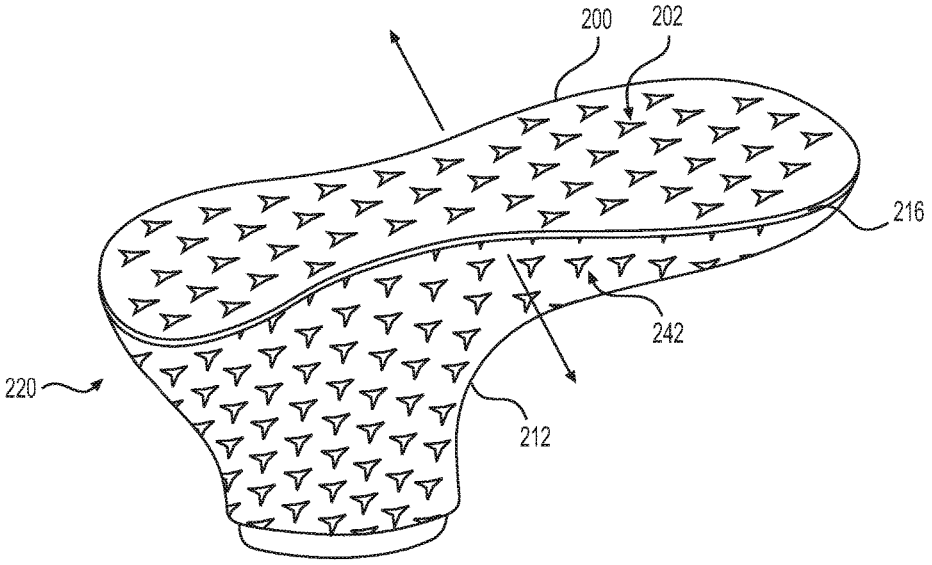
FIG. 23 is a schematic view of the sole structure being tensioned.

Referring now to FIG. 22, sole structure 200 may be placed along last 210. As shown, sole structure 200 may not extend to edge 216 of upper 212. Sole structure 200 may be designed such that when stretched, as shown in FIG. 23, sole structure 200 may align with edge 216. That is, sole structure 200 may be designed such that when tensioned, sole structure 200 will align with edge 216 from heel region 14 to forefoot region 10 and from medial side 18 to lateral side 20. Therefore, as shown in FIG. 22, plurality of apertures 202 may be closed or collapsed when not tensioned. This design may allow for sole structure 200 to be able to stretch a large amount and to attach to upper 212 at a particular tension to upper 212.

Referring particularly to FIG. 23, sole structure 200 may be tensioned such that the periphery of sole structure 200 aligns with edge 216. In a similar manner as described in reference to an alternate embodiment, upper 212 may be secured to sole structure 200 in this configuration. While stretched, sole structure 200 may be glued, stitched, fastened, or otherwise secured to upper 212.

As shown in FIG. 23, article of footwear 220 or simply article 220 may be formed by securing sole structure 200 to upper 212. In some embodiments, sole structure 200 and upper 212 may be stretched to a same or similar tension. In some embodiments, therefore, the size of plurality of apertures 242 and plurality of apertures 202 may be substantially the same when tensioned as shown in FIG. 23. In other embodiments, various portions of sole structure 200 and upper 212 may have similar or substantially the same tension levels. By matching the tension of upper 212 and sole structure 200, the article of footwear 220 formed with both upper 212 and sole structure 200 may stretch in a substantially uniform manner.

Figure 24:
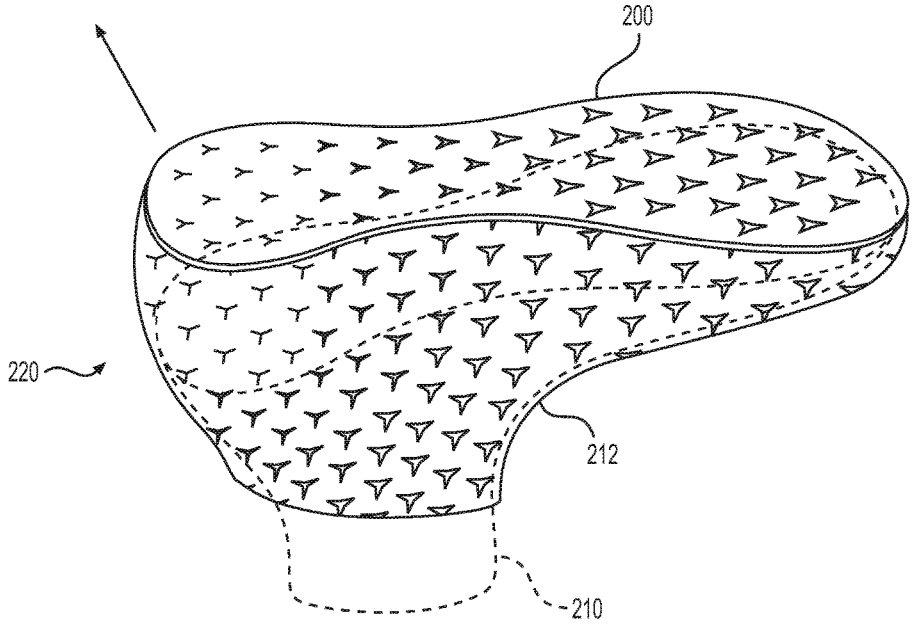
FIG. 24 is a schematic view of an embodiment of an article of footwear being removed from the last.

Referring now to FIG. 24, article 220 is depicted being removed from last 210. Because both upper 212 and sole structure 200 include plurality of apertures 242 and plurality of apertures 202, upper 212 and sole structure 200 may stretch during the removal process. By arranging the plurality of apertures 202 in an auxetic configuration, it may be easier to remove article 220 from last 210 when compared to other articles that do not include apertures arranged in an auxetic configuration. In contrast to other embodiments that may utilize apertures that are not arranged in an auxetic configuration, the arrangement of the apertures in article 220 allow article 220 to expand in multiple directions when subjected to a tensile force. For example, by tensioning sole structure 200 laterally, sole structure 200 will expand laterally as well as longitudinally. In other embodiments without apertures in an auxetic configuration, tensioning sole structure 200 laterally will decrease the length of sole structure 200 longitudinally. Decreasing the length of sole structure 200 may inhibit article 220 from being removed from last 210. The arrangement of apertures in an auxetic configuration may therefore assist in removing article 220 from last 210.

Figure 25:
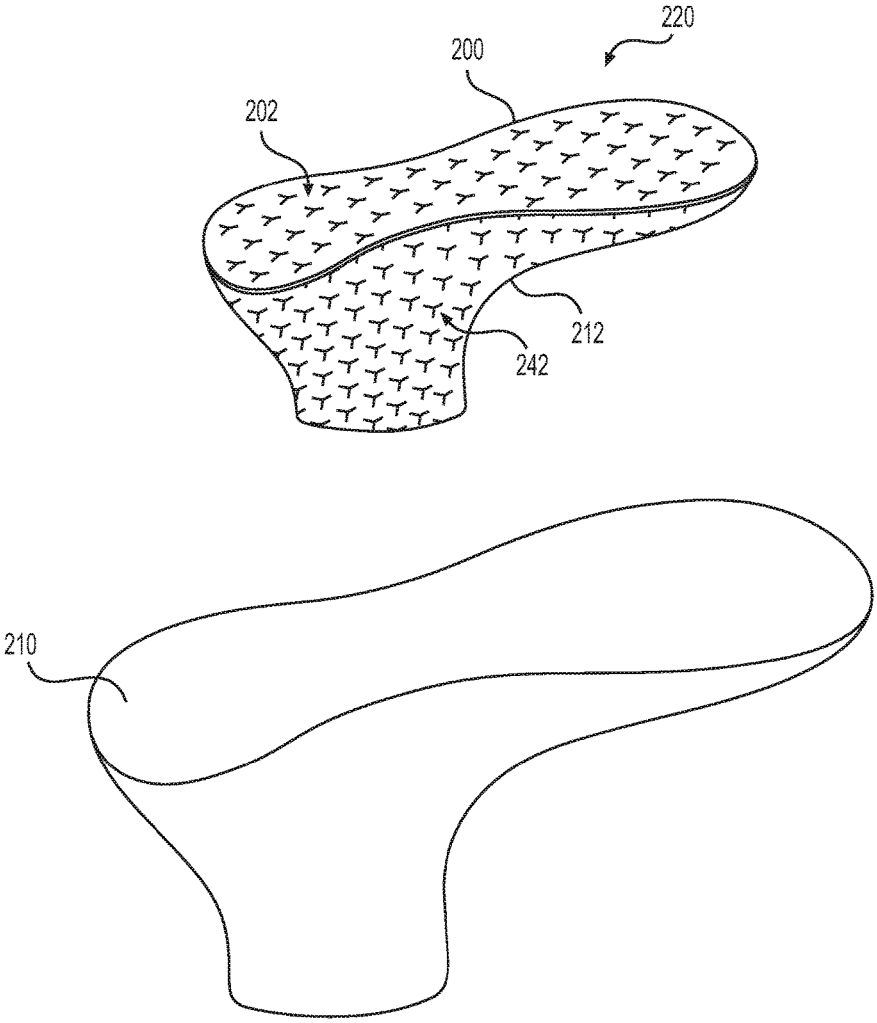
FIG. 25 is a schematic view of the article of footwear completely removed from the last.

Referring now to FIG. 25, article 220 is depicted removed from last 210. As shown, article 220 is smaller laterally, longitudinally, and vertically than when article 220 was mounted on last 210. As discussed previously, because upper 212 and sole structure 200 were tensioned or stretched around last 210 during assembly, when removed from last 210 the tension may be released. As shown, plurality of apertures 242 of upper 212 and plurality of apertures 202 of sole structure 200 may be closed or reduced in cross-sectional area. The reduction in size may cause the overall size of upper 212 and sole structure 200 to be reduced, thereby reducing the size of article 220.

Figure 26:
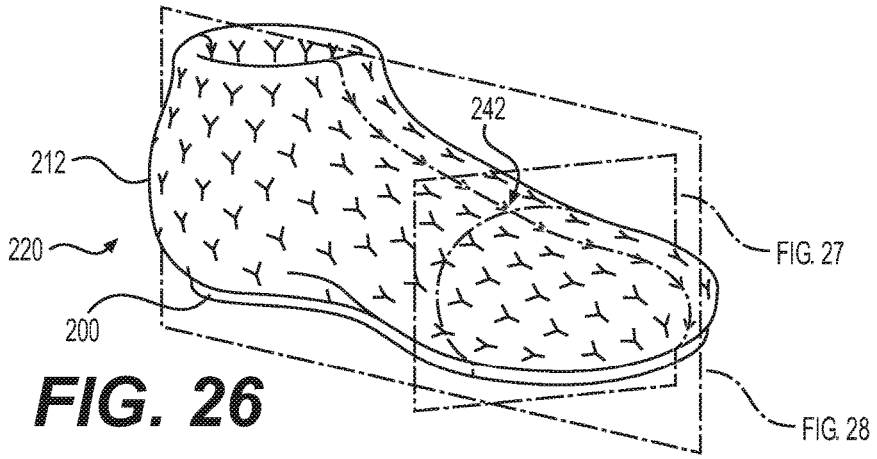
FIG. 26 is an isometric view of an embodiment of an article of footwear in a relaxed state.
Figure 27:
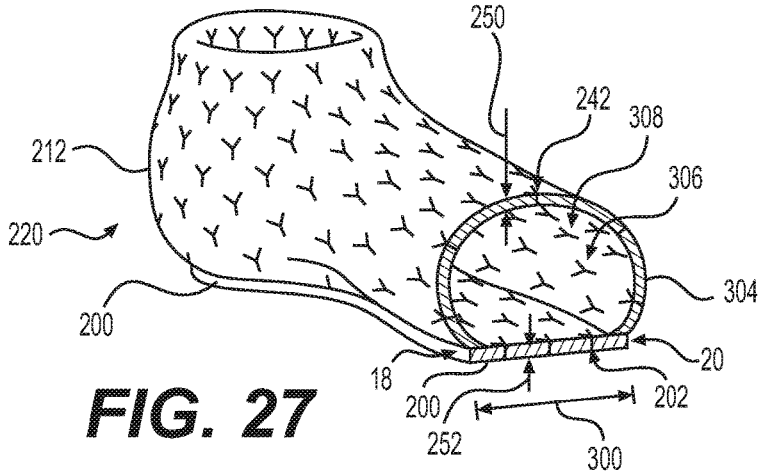
FIG. 27 is an isometric cutaway view of the article of footwear from FIG. 26 in a relaxed state.
Figure 28:
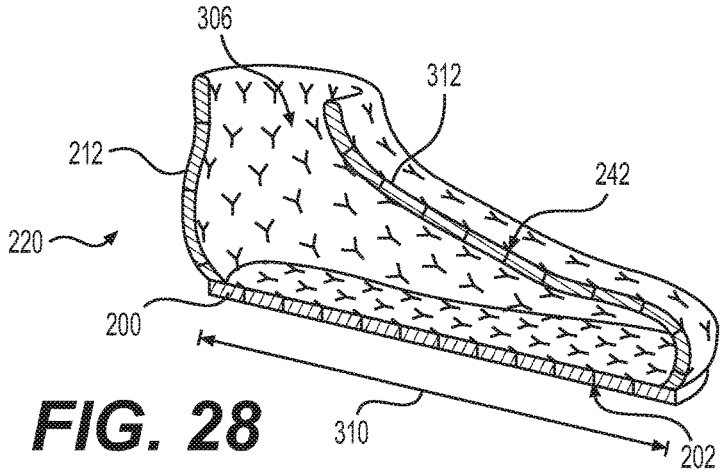
FIG. 28 is an alternate isometric cutaway view of the article of footwear from FIG. 26 in a relaxed state.

Referring now to FIGS. 26 through 28, various views of article 220 are shown. In these figures, article 220 is depicted in a relaxed or untensioned state. FIG. 26 is an isometric view of article 220. As shown in FIG. 26, plurality of apertures 242 of upper 212 are in a closed or relaxed state. FIG. 27 includes a depiction of a lateral cross section of article 220 through sole structure 200 and upper 212. FIG. 28 includes a depiction of a longitudinal cross section of article 220 through sole structure 200 and upper 212.

As shown in FIG. 27, sole structure 200 has an untensioned width 300. Because plurality of apertures 202 of sole structure 200 are narrow or closed, the width of sole structure 200 may be narrower than when sole structure 200 is tensioned. Similarly, apertures 242 of upper 212 may also be narrow or closed. Because plurality of apertures 242 are narrow or closed, untensioned lateral perimeter 304 may be shorter or smaller than the perimeter of upper 212 when upper 212 is tensioned. Untensioned lateral perimeter 304 may refer to the cross-sectional perimeter of upper 212 from medial side 18 to lateral side 20 of article 220. By changing the perimeter of upper 212, the cross-sectional area of cavity 306 may also be varied or changed. As shown in FIG. 27, lateral cross-sectional area 308 of cavity 306 may be smaller than when upper 212 is tensioned. Additionally, tensioning sole structure 200 may also contribute to enlarging lateral cross-sectional area 308. Because both sole structure 200 and upper 212 bound cavity 306, when either or both of sole structure 200 and upper 212 change in length the volume of cavity 306 may change and also the cross-sectional area of various portions of article 220 may also change.

In some embodiments, the upper and the sole structure of an article of footwear may have various thicknesses. As shown in FIG. 27, upper 212 has thickness 250 and sole structure 200 has thickness 252. In some embodiments, thickness 250 of upper 212 may be similar to thickness 252 of sole structure 200. In other embodiments, thickness 250 may be greater than thickness 252. In still further embodiments, thickness 250 may be less than thickness 252. The thickness of various components of article 220 may be varied to alter the amount of cushioning, support, or other attributes.

Referring now to FIG. 28, a longitudinal cross section of article 220 is depicted. As shown, plurality of apertures 202 of sole structure 200 and plurality of apertures 242 of upper 212 may be narrow or closed in the relaxed state. In this configuration, sole structure 200 has untensioned length 310. Because plurality of apertures 202 are closed or narrow in the untensioned configuration, untensioned length 310 may be less than in embodiments in which sole structure 200 is subjected to a tensile force. Further, as shown in FIG. 28, upper 212 includes untensioned longitudinal perimeter 312. Untensioned longitudinal perimeter 312 may extend from a toe edge of sole structure 200 to a heel edge of sole structure 200. In this configuration, untensioned longitudinal perimeter 312 may be smaller than a longitudinal perimeter when article 220 is tensioned.

In the configuration as shown, cavity 306 may have a relatively smaller volume when compared to a tensioned article 220. As shown, therefore, article 220 may occupy a smaller space or volume when compared to other embodiments that do not include pre-stretched or pre-tensioned auxetic features. Because article 220 may be smaller than other articles, packaging and storage of article 220 may be less than other embodiments that do not utilize auxetic apertures in an upper and the sole structure. By reducing the amount of space necessary to store article 220, the quantity of money necessary to form a box or other receptacle may be decreased as well as cost of storage.

Figure 29:
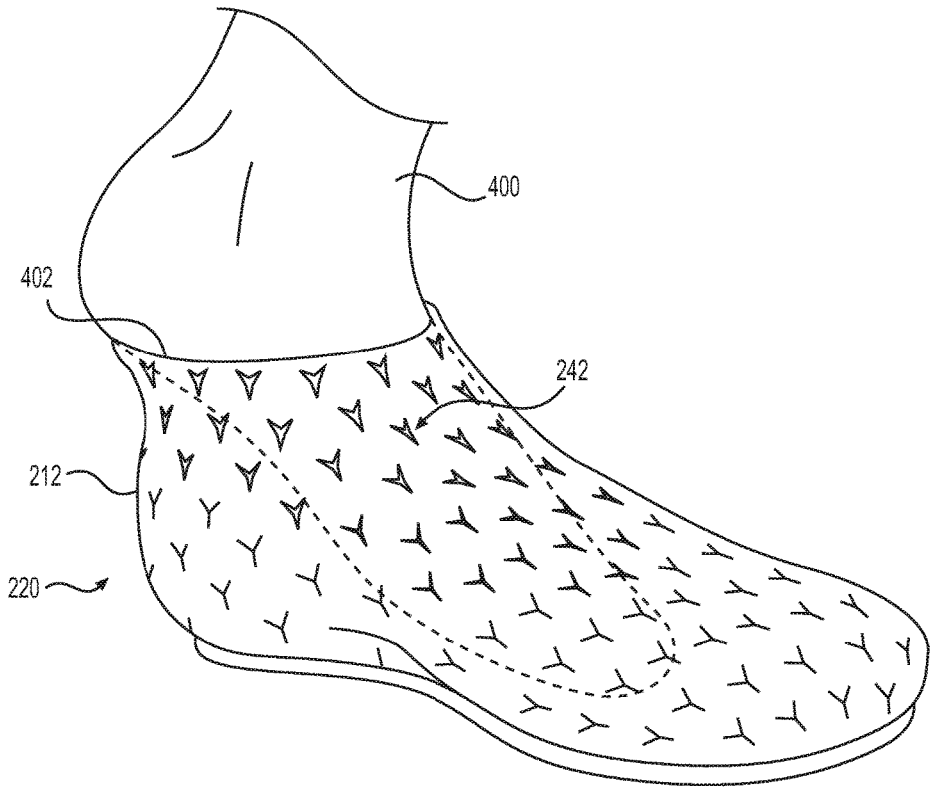
FIG. 29 is a schematic view of a foot being inserted into the article of footwear of FIG. 26.

Referring now to FIGS. 29-32, a foot may be inserted into article 220. As shown in FIG. 29, foot 400 is inserted through ankle opening 402 of article 220. As shown, plurality of apertures 242 of upper 212 may expand thereby assisting in the insertion of foot 400 into article 220.

Figure 30:
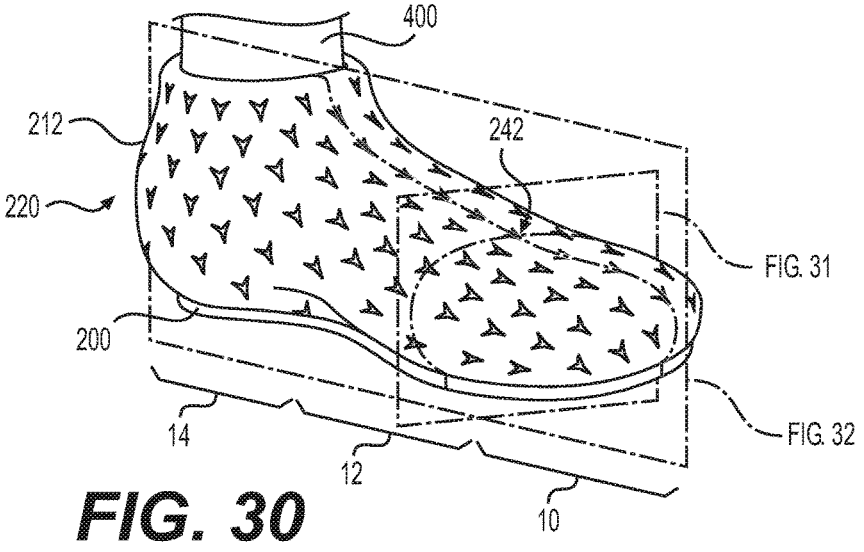
FIG. 30 is an isometric view of an article of footwear with a foot inserted into the article of footwear.
Figure 31:
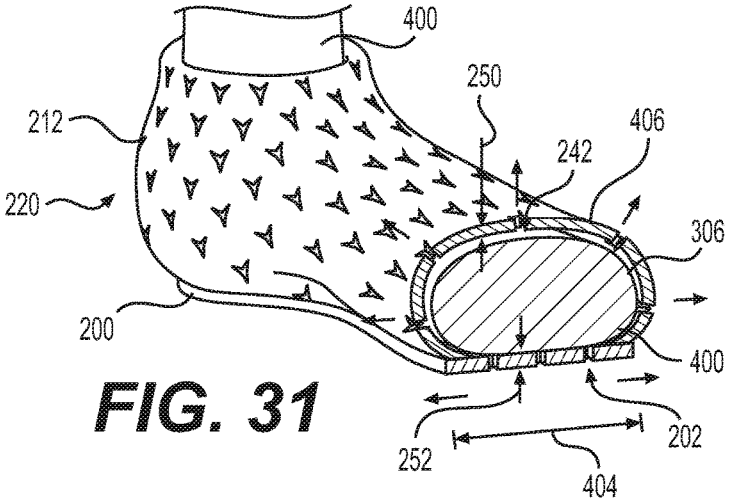
FIG. 31 is an isometric cutaway view of the article of footwear of FIG. 30.
Figure 32:
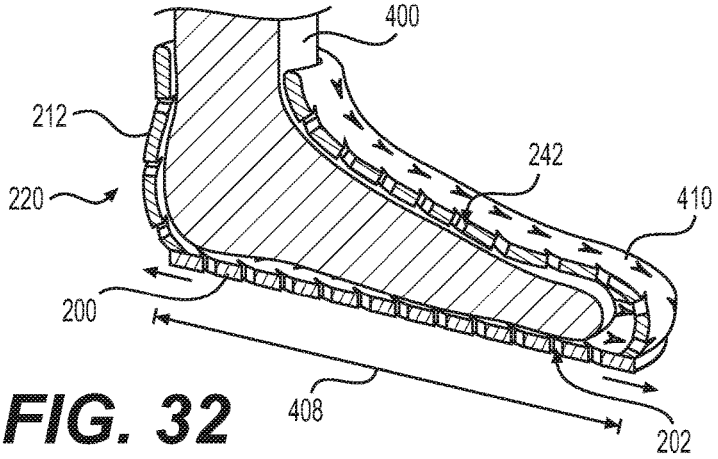
FIG. 32 is an alternate isometric cutaway view of the article of footwear of FIG. 30.

Referring now to FIGS. 30-32, various views of article 220 with foot 400 are depicted. As shown in FIG. 30, plurality of apertures 242 may expand when foot 400 is inserted into article 220. Although plurality of apertures 242 are shown as expanding to the same degree, it should be recognized that each aperture of plurality of apertures 242 may expand at different rates or to different sizes depending on the amount of force that each area of upper 212 receives. For example, in some embodiments, foot 400 may be wider in forefoot region 10 than in heel region 14. Therefore, in some embodiments, plurality of apertures 242 in forefoot region 10 may not expand to the same degree or the same amount as plurality of apertures 242 in heel region 14.

Referring to FIG. 31, a lateral cross section of article 220 is depicted. As shown, foot 400 presses against upper 212 and causes plurality of apertures 242 to expand. Additionally, foot 400 may also cause plurality of apertures 202 to expand. By expanding upper 212 and sole structure 200, foot 400 may also increase the volume of cavity 306.

As shown in FIG. 31, as plurality of apertures 202 expand, the width of sole structure 200 increases to tensioned width 404. In this embodiment, tensioned width 404 may be larger than untensioned width 300. The ability of sole structure 200 to conform and react to the size and shape of foot 400 may increase comfort and feel when compared to embodiments that do not include apertures arranged in an auxetic configuration. Additionally, tensioned lateral perimeter 406 may be larger than untensioned lateral perimeter 304. Because tensioned lateral perimeter 406 and tensioned width 404 of article 220 may be larger than article 220 in an untensioned state, the lateral cross-sectional area of article 220 may be larger than lateral cross-sectional area 308 of untensioned article 220. The larger cross-sectional area of the tensioned article 220 may allow article 220 to accommodate various sizes of feet in a comfortable manner. By including various apertures with an auxetic configuration, pressure points along foot 400 may be reduced.

In some embodiments, upper 212 and sole structure 200 may press against foot 400 such that article 220 tightly or closely contours to the shape and size of foot 400. This tight fit may mimic a barefoot feeling to the user. Additionally, because article 220 may expand different amounts based on differing levels of tension, users with differently shaped feet may be able to have comfortable and form-fitting articles of footwear with the same article of footwear. That is, a single article of footwear may fit comfortably on differently shaped feet.

In some embodiments, the thickness of various components of an article may remain substantially consistent when stretched. As shown in FIG. 31, thickness 250 of upper 212 remains substantially unchanged in a stretched configuration. Additionally, thickness 252 of sole structure 200 also remains substantially unchanged in a stretched configuration. Thickness 250 may remain substantially the same between upper 212 when untensioned and upper 212 when tensioned because when upper 212 is stretched, plurality of apertures 242 are opened or expanded. Similarly, plurality of apertures 202 of sole structure 200 are opened or expanded when stretched. Because the plurality of apertures are able to be opened or expanded, the amount of stress on the material that forms upper 212 and sole structure 200 may be reduced. Therefore, the material that forms upper 212 and sole structure 200 may not stretch to the same degree as an upper or sole structure that does not include auxetic apertures. For example, a sole structure that does not include apertures may stretch laterally and longitudinally; however, when stretched laterally and longitudinally the sole structure would also diminish in thickness. That is because without apertures that material that forms the sole structure itself would stretch, as compared with the present embodiment that utilizes the mechanical structure of sole structure 200 and upper 212 to expand.

Referring now to FIG. 32, a longitudinal cross section of article 220 is depicted. As shown, plurality of apertures 242 and plurality of apertures 202 have expanded and have therefore enlarged the longitudinal perimeter as well as the length of article 220. For example, tensioned longitudinal perimeter 410 may be larger or longer than untensioned longitudinal perimeter 312. Additionally, tensioned length 408 may be longer or larger than untensioned length 310. The expansion of the length, width, and perimeter of article 220 may allow for variously shaped feet to be inserted into article 220. Additionally, because various portions stretch when subjected to force, article 220 may conform to foot 400.

Figure 33:
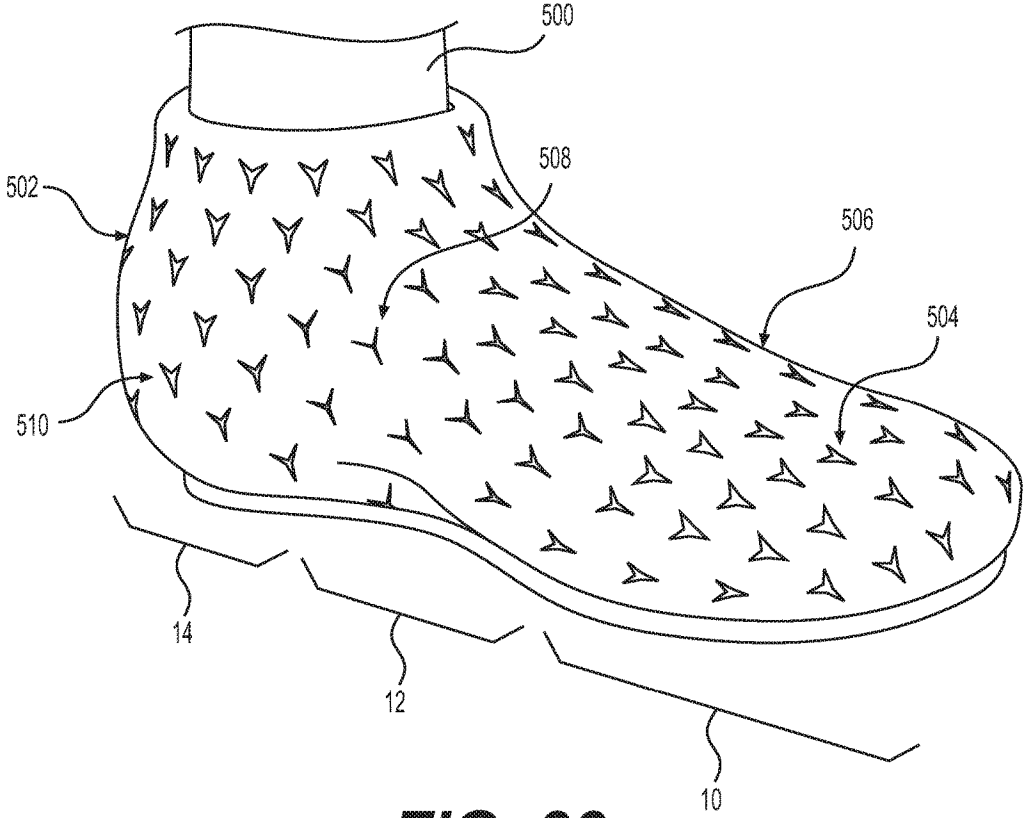
FIG. 33 is an isometric view of an embodiment of an article of footwear on a foot.

Referring now to FIG. 33, an alternate article of footwear is depicted. As shown, article 502 includes plurality of apertures 504. Plurality of apertures 504 may be arranged in an auxetic configuration as discussed previously in regard to other embodiments. Foot 500 may be inserted into article 502 and cause various portions of article 502 to stretch with respect to other portions. Because foot 500 may not have a uniform shape or size, various portions of article 502 may stretch to varying degrees with respect to each other. For example, forefoot apertures 506 in forefoot region 10 may stretch to a greater degree than midfoot apertures 508 in midfoot region 12. Further, heel apertures 510 in heel region 14 may stretch to a greater degree than midfoot apertures 508.

In some embodiments, the size of plurality of apertures 504 may be varied in a pre-stretched formation. That is, prior to forming article 502, plurality of apertures 504 may be particularly sized for a desired effect. For example, in a pre-stretched formation, midfoot apertures 508 may be smaller than forefoot apertures 506. When worn by a user, in some embodiments, midfoot apertures 508 and forefoot apertures 506 may be approximately the same size. By determining where on article 502 various pressure points may be located, article 502 may be designed to have apertures of generally the same size when worn by a user. This may give a user a uniform feel through article 502 around foot 500.

Figure 35:
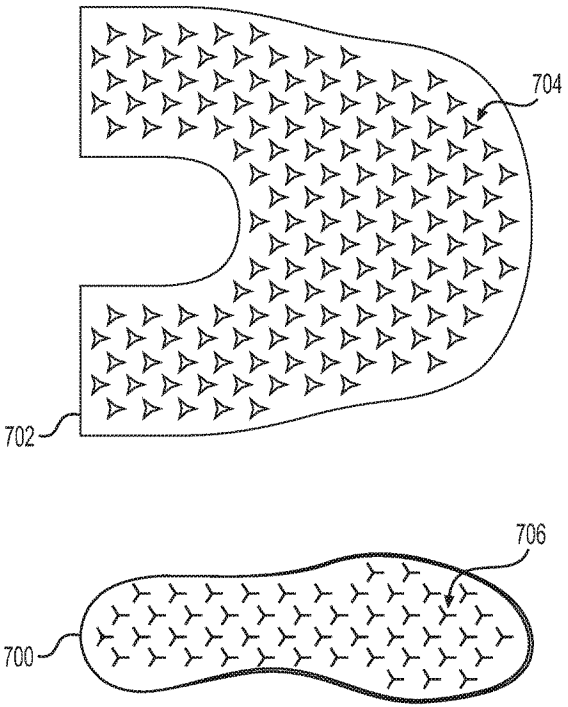
FIG. 35 is a schematic view of an alternate embodiment set of an upper and a sole structure.
Figure 34:
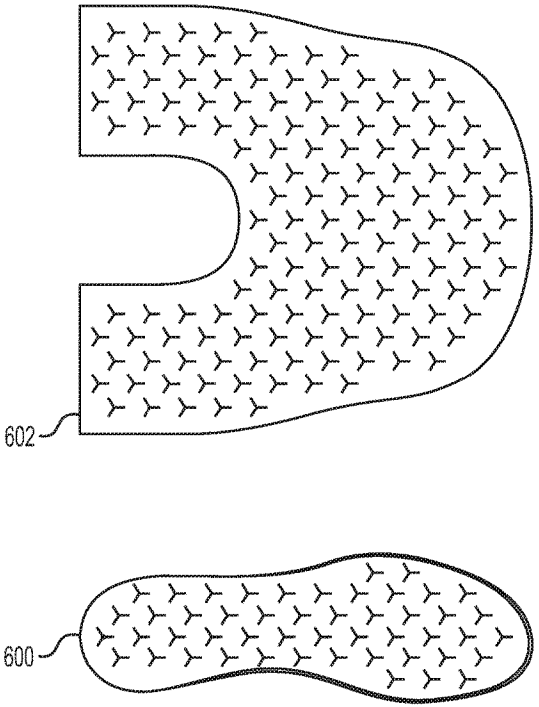
FIG. 34 is a schematic view of an embodiment set of an upper and a sole structure.

In some embodiments, a sole structure and an upper may be designed to have different stretch properties. For example, sole structure 600 and upper 602 shown in FIG. 34 may have substantially similar sized apertures. In such an embodiment, when assembled, an article of footwear may have similarly shaped apertures. An article in this configuration may require the same magnitude of force in order to stretch upper 602 as well as sole structure 600. That is, the apertures of upper 602 and sole structure 600 may expand at a substantially similar rate when subjected to a substantially similar magnitude of force. In other embodiments, such as shown in FIG. 35, an upper and a sole structure may have differently shaped apertures. For example, plurality of apertures 704 of upper 702 may be larger than plurality of apertures 706 of sole structure 700. An article may be designed in this manner in order to limit stretch in various areas. Plurality of apertures 704 may have a small amount that they may be permitted to stretch. In contrast, plurality of apertures 706 of sole structure 700 are shown as slits. Such a configuration may allow plurality of apertures 706 to stretch to a greater degree than plurality of apertures 704. Both plurality of apertures 704 and plurality of apertures 706 generally may expand to a triangular shape. However, plurality of apertures 706 are further away from the triangular shape than are plurality of apertures 704. That is, plurality of apertures 706 have greater room or ability to expand than plurality of apertures 704. Because of this difference, sole structure 700 may increase a greater amount in length and in width or at a greater rate when subjected to tension than upper 702. By varying the geometry of the plurality of apertures in a sole structure or upper, the amount of stretch may therefore be limited, increased, or otherwise customized.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A method of manufacturing an article of footwear comprising:

providing a sole structure in a relaxed state that includes a plurality of apertures, wherein the plurality of apertures are arranged in an auxetic configuration;

placing the sole structure under tension such that the sole structure undergoes auxetic expansion; and attaching an upper to the sole structure while the sole structure is under tension.

2. The method according to claim 1, further comprising releasing tension from the sole structure such that the sole structure returns to the relaxed state.

3. The method according to claim 1, further comprising:

providing a last;

wherein the last has a lower last surface with a lower last surface area;

wherein the sole structure has a last contacting surface with an interior surface area; and wherein the lower last surface area is greater than the interior surface area of the last contacting surface when the sole structure is in the relaxed state.

4. The method according to claim 3, wherein the interior surface area of the last contacting surface is equal to the lower last surface area when the sole structure is tensioned.

5. The method according to claim 3, further comprising attaching the upper to the sole structure while the sole structure is tensioned to form an article, wherein the article defines a cavity with a tensioned volume while the sole structure is tensioned.

6. The method according to claim 5, further comprising removing the article from the last such that the sole structure reverts to the relaxed state, wherein the cavity has a relaxed volume when the sole structure is in the relaxed state, and the relaxed volume is less than the tensioned volume.

7. The method according to claim 1, wherein placing the sole structure under tension includes applying tension laterally across the sole structure, and the laterally applied tension causes the sole structure to expand both laterally and longitudinally.

8. The method according to claim 1, wherein the sole structure has a first length and a first width in the relaxed state, the sole structure has a second length and a second width in a tensioned state, the second width is greater than the first width, and the second length is greater than the first length.

9. A method of manufacturing an article of footwear comprising:

forming a sole structure with a plurality of apertures, wherein the plurality of apertures are spaced in an auxetic configuration, and the sole structure has a first sole length and a first sole width;

providing a last with a lower surface, the last including a last length and a last width, wherein the first sole length is less than the last length, the first sole width is less than the last width;

tensioning the sole structure laterally such that the sole structure expands both laterally and longitudinally, wherein the tensioned sole structure has a second sole length and a second sole width, the second sole length is greater than the first sole length, and the second sole width is greater than the first sole width;

disposing the tensioned sole structure on the lower surface of the last; and attaching an upper to the tensioned sole structure.

10. The method according to claim 9, further comprising removing the upper and the sole structure from the last, wherein the sole structure reverts to having the first sole length and the first sole width after being removed from the last.

11. The method according to claim 9, wherein the sole structure is formed of foam.

12. The method according to claim 9, wherein the upper includes a plurality of apertures, and the plurality of apertures are arranged in an auxetic configuration.

13. The method according to claim 11, wherein, while the sole structure is tensioned, the plurality of apertures of the sole structure are substantially the same size as the plurality of apertures of the upper while the upper is tensioned.

14. The method according to claim 11, wherein, while the sole structure is tensioned, the plurality of apertures of the sole structure are larger than the plurality of apertures of the upper while the upper is tensioned.

15. The method according to claim 11, wherein the upper attached to the sole structure forms an article located on the last, the article has a cavity, and the cavity having a tensioned volume while the article is on the last.

16. The method according to claim 15, further comprising removing the article from the last such that the sole structure reverts to the first sole width and first sole length, wherein the cavity has a relaxed volume, and the relaxed volume is less than the tensioned volume.

* * * * *